US011519403B1

(12) United States Patent
McCarthy

(10) Patent No.: US 11,519,403 B1
(45) Date of Patent: Dec. 6, 2022

(54) COMPRESSOR FOR PUMPING FLUID HAVING CHECK VALVES ALIGNED WITH FLUID PORTS

(71) Applicant: I-JACK TECHNOLOGIES INCORPORATED, Moosomin (CA)

(72) Inventor: Dan McCarthy, Moosomin (CA)

(73) Assignee: I-JACK TECHNOLOGIES INCORPORATED, Moosomin (CA)

( * ) Notice: Subject to any disclaimer, the term of this patent is extended or adjusted under 35 U.S.C. 154(b) by 0 days.

(21) Appl. No.: 17/483,452

(22) Filed: Sep. 23, 2021

(51) Int. Cl.
*F04B 5/02* (2006.01)
*F04B 39/12* (2006.01)
*F04B 9/109* (2006.01)

(52) U.S. Cl.
CPC ..... *F04B 39/123* (2013.01); *F04B 5/02* (2013.01); *F04B 9/109* (2013.01)

(58) Field of Classification Search
CPC .. F04B 5/02; F04B 39/10; F04B 39/12; F04B 39/123; F04B 47/02; F04B 47/04; F04B 53/10; F04B 53/16; F04B 7/0266; F04B 9/109; F04B 15/02; F04B 39/125
USPC ..... 417/442
See application file for complete search history.

(56) References Cited

U.S. PATENT DOCUMENTS 1,619,475 A 3/1927 Hubbard
2,303,597 A * 12/1942 Adelson ..... F04B 43/009 417/63
2,946,316 A 7/1960 Bruehl
3,632,234 A 1/1972 Lake
3,801,230 A 2/1974 Brown
4,013,385 A 3/1977 Peterson
4,380,150 A 4/1983 Carlson
4,390,322 A 6/1983 Budzich
4,512,151 A 4/1985 Yamatani
4,515,516 A 5/1985 Perrine et al.
4,516,473 A 5/1985 Oneyama et al.
4,653,986 A 3/1987 Ashton
4,761,118 A 8/1988 Zanarini
4,861,239 A 8/1989 Simmons et al.
(Continued)

FOREIGN PATENT DOCUMENTS

CA 2165063 A1 3/1995
CA 2309970 C 7/1999
(Continued)

OTHER PUBLICATIONS

Brahma Compression Ltd., "CGR50 Casing Gas Recovery Unit", www.gascompressors.ca, before Apr. 21, 2016, 8 pages.
(Continued)

*Primary Examiner* — Thomas Fink

(57) ABSTRACT

A compressor comprises a first cylinder for compressing a fluid and a second cylinder for driving a piston in the first cylinder. The first cylinder comprises a chamber with first and second ends. The piston is reciprocally movable along an axial direction of the chamber for compressing a fluid. Three or more first ports at the first end include at least one first inlet port and at least one first outlet port. Three or more second ports at the second end include at least one second inlet port and at least one second outlet port. Each port has an axial direction parallel to the axial direction of the chamber. A check valve is connected inline with each port along the axial direction of the port.

5 Claims, 30 Drawing Sheets

(56) References Cited

U.S. PATENT DOCUMENTS

| | | | | |
|---|---|---|---|---|
| 4,949,805 | A | 8/1990 | Mather et al. | |
| 4,990,058 | A | 2/1991 | Eslinger | |
| 5,238,372 | A | 8/1993 | Morris | |
| 5,281,100 | A | 1/1994 | Diederich | |
| 5,450,901 | A | 9/1995 | Ellwood | |
| 5,481,873 | A | 1/1996 | Saruwatari et al. | |
| 5,584,664 | A | 12/1996 | Elliott et al. | |
| 5,622,478 | A | 4/1997 | Elliott et al. | |
| 5,743,716 | A | 4/1998 | Smith | |
| 5,782,612 | A | 7/1998 | Margardt | |
| 5,807,083 | A | 9/1998 | Tomoiu | |
| 5,868,122 | A | 2/1999 | Gram et al. | |
| 6,408,736 | B1 | 6/2002 | Holt et al. | |
| 6,422,313 | B1 | 7/2002 | Knight | |
| 6,568,911 | B1 | 5/2003 | Brightwell et al. | |
| 6,652,241 | B1 | 11/2003 | Alder | |
| 7,255,540 | B1 | 8/2007 | Cooper | |
| 7,527,482 | B2 | 5/2009 | Ursan et al. | |
| 7,730,939 | B2 | 6/2010 | Merrick, III | |
| 7,762,321 | B2 | 7/2010 | Fesi et al. | |
| 7,766,079 | B2 | 8/2010 | Hoffarth | |
| 8,046,990 | B2 | 11/2011 | Bollinger et al. | |
| 8,047,820 | B2 | 11/2011 | Merrick, III | |
| 8,066,496 | B2 | 11/2011 | Brown | |
| 8,136,586 | B2 | 3/2012 | Merrick, III | |
| 8,147,218 | B2 | 4/2012 | Thrasher et al. | |
| 8,161,741 | B2 | 4/2012 | Ingersoll et al. | |
| 8,226,370 | B2 | 7/2012 | Wu et al. | |
| 8,297,362 | B1 | 10/2012 | Strider et al. | |
| 8,387,375 | B2 | 3/2013 | Blieske | |
| 8,851,860 | B1 | 10/2014 | Mail | |
| 9,109,511 | B2 | 8/2015 | Ingersoll et al. | |
| 9,359,876 | B2 | 6/2016 | Fink | |
| 9,605,805 | B2 | 3/2017 | Calvin et al. | |
| 9,745,975 | B2 | 8/2017 | Dancek | |
| 9,816,497 | B2 | 11/2017 | Strickland et al. | |
| 10,072,487 | B2 | 9/2018 | McCarthy | |
| 10,167,857 | B2 | 1/2019 | McCarthy | |
| 2004/0162658 | A1 | 8/2004 | Newman | |
| 2005/0103576 | A1 | 5/2005 | Engstrom | |
| 2005/0175476 | A1 | 8/2005 | Patterson | |
| 2005/0180864 | A1 | 8/2005 | Ursan et al. | |
| 2006/0011264 | A1* | 1/2006 | Palmer | F04B 49/22 141/231 |
| 2007/0041847 | A1 | 2/2007 | Inoue et al. | |
| 2009/0194291 | A1 | 8/2009 | Fesi et al. | |
| 2009/0246049 | A1 | 10/2009 | Merrick, III | |
| 2010/0172771 | A1 | 7/2010 | Hoffarth | |
| 2012/0204548 | A1 | 8/2012 | Turnis et al. | |
| 2012/0224977 | A1 | 9/2012 | Sotz et al. | |
| 2012/0247785 | A1 | 10/2012 | Schmitt | |
| 2013/0094978 | A1 | 4/2013 | Hoffarth | |
| 2014/0093395 | A1 | 4/2014 | Leavy et al. | |
| 2014/0219830 | A1 | 8/2014 | Strickland et al. | |
| 2014/0231093 | A1 | 8/2014 | Hoell | |
| 2014/0294635 | A1 | 10/2014 | Rietkerk | |
| 2014/0353391 | A1 | 12/2014 | Burklin et al. | |
| 2014/0377081 | A1* | 12/2014 | Bagagli | F04B 35/01 417/288 |
| 2015/0233368 | A1 | 8/2015 | Gallaway | |
| 2015/0240799 | A1 | 8/2015 | Obrejanu et al. | |
| 2015/0361970 | A1 | 12/2015 | White et al. | |
| 2016/0032911 | A1 | 2/2016 | McCoy | |
| 2016/0258426 | A1 | 9/2016 | Tao et al. | |
| 2017/0321526 | A1 | 11/2017 | McCarthy | |
| 2019/0301446 | A1* | 10/2019 | Khaire | F04B 53/1087 |
| 2020/0040882 | A1 | 2/2020 | Kalmari et al. | |

FOREIGN PATENT DOCUMENTS

| | | | |
|---|---|---|---|
| CA | 2353391 | A1 | 6/2000 |
| CA | 2331931 | A1 | 7/2002 |
| CA | 2379766 | C | 10/2004 |
| CA | 2644346 | A1 | 5/2010 |
| CA | 2803208 | A1 | 2/2012 |
| CA | 2891110 | A1 | 5/2013 |
| CA | 2599447 | C | 7/2013 |
| CA | 2843321 | C | 2/2015 |
| CA | 2861781 | C | 3/2016 |
| CN | 2445111 | Y | 8/2001 |
| CN | 1326050 | A | 12/2001 |
| CN | 201103527 | Y | 8/2008 |
| CN | 201103528 | Y | 8/2008 |
| CN | 201225264 | Y | 4/2009 |
| CN | 202108682 | U | 1/2012 |
| CN | 202360325 | U | 8/2012 |
| CN | 202674817 | U | 1/2013 |
| WO | 2011/079267 | A1 | 6/2011 |
| WO | 2011/079271 | A2 | 6/2011 |
| WO | 2012/012896 | A1 | 2/2012 |
| WO | 2013/064748 | A1 | 5/2013 |
| WO | 2013/071134 | A1 | 5/2013 |
| WO | 2013/177268 | A1 | 11/2013 |
| WO | 2014/113545 | A1 | 7/2014 |
| WO | 2016/037500 | A1 | 3/2016 |

OTHER PUBLICATIONS

Brittania Industries 2009 Inc., "Casing Gas Compressor Packages", www.brittaniaindustries.com, before Apr. 21, 2016, 2 pages.

Broadwind Energy and Safe North America, "CNG BOOST™ (Hydraulic Compressor) System Operation and Technology Overview", www.bwen.com and www.safegas.it/en/, before Apr. 21, 2016, 3 pages.

Karl Bratt; Jonathan Haines; Andrew Hall; and Brandon Koster, "Project Proposal & Feasibility Study NaturaFill: Fuel for Thought", © 2013, Karl Bratt, Jonathan Haines, Andrew Hall, Brandon Koster, and Calvin College, Updated: Dec. 9, 2013, 59 pages.

Karl Bratt; Jonathan Haines; and Brandon Koster, "Final Design Report NaturaFill: Fuel for Thought", © 2014, Karl Bratt, Jonathan Haines, Brandon Koster, and Calvin College, Updated: May 15, 2014, 112 pages.

Chemac Inc., "Hofer Piston compressors with hydraulic drive unit", www.chemacinc.com, before Apr. 21, 2016, 4 pages.

Corken, Inc. (A Unit of IDEX Corporation), "Sour Gas Compressors Oil & Natural Gas Applications", http://www.corken.com, Jul. 2015, 8 pages.

Hans Turck Gmbh & Co. KG, "Inductive sensor BI5-EM18-Y1X-H1141", www.turck.com, before Apr. 21, 2016, 4 pages.

Compact Compression Inc., "Casing Gas Compression", http://www.compactcompression.com, before Apr. 21, 2016, 32 pages.

Permian Production Equipment, Inc., "The Hydraulic Beam Gas Compressor® Your Solution When More Production is the Question", www.hydraulic.beamgascompressor.com, before Apr. 21, 2016, 4 pages.

Linde Hydraulics Gmbh & Co. KG, "HPV-02. Variable pumps for closed loop operation.", http://www.linde-hydraulics.com, before Apr. 21, 2016, 36 pages.

Hoerbiger, "Ring and packing Sealing systems for reciprocating compressors", http://www.hoerbiger.com, before Apr. 21, 2016, 24 pages.

Krzysztof Palka, "Understanding Sucker Rod Pump Operation with Hydraulic Jack", © Krzysztof Palka 2015, 27 pages.

Non-Final Office Action issued by the U.S. Patent and Trademark Office dated Sep. 1, 2017 in connection with U.S. Appl. No. 15/656,252, 25 pages.

Final Office Action issued by the U.S. Patent and Trademark Office dated Nov. 24, 2017 in connection with U.S. Appl. No. 15/656,252, 21 pages.

I-Jack Technologies Incorporated, "IJack DGAS Product Manual Publication No. 800-0030 Rev 2.1", before before May 31, 2017, 34 pages.

Non-Final Office Action issued by the U.S. Patent and Trademark Office dated Feb. 20, 2018 in connection with U.S. Appl. No. 15/822,035, 27 pages.

Non-Final Office Action issued by the U.S. Patent and Trademark Office dated Feb. 15, 2019 in connection with U.S. Appl. No. 15/659,229, 19 pages.

(56) References Cited

OTHER PUBLICATIONS

Non-Final Office Action issued by the U.S. Patent and Trademark Office dated Oct. 18, 2018 in connection with U.S. Appl. No. 16/059,891, 8 pages.
Non-Final Office Action issued by the U.S. Patent and Trademark Office dated Jan. 17, 2018 in connection with U.S Appl. No. 15/786,369, 13 pages.
Non-Final Office Action issued by the U.S. Patent and Trademark Office dated May 2, 2019 in connection with U.S. Appl. No. 16/147,188, 7 pages.

* cited by examiner

300

COMPRESSOR FOR PUMPING FLUID HAVING CHECK VALVES ALIGNED WITH FLUID PORTS

FIELD

The present disclosure relates generally to fluid compression or pumping devices and systems, and specifically to fluid compressors having fluid ports and check valves connected to the ports.

BACKGROUND

Fluid compressors are useful for pumping fluids. A fluid compressor typically has a fluid chamber and a pair of fluid ports serving as an inlet or outlet of the fluid chamber. Check valves may be connected to the fluid ports for controlling fluid flow through the inlet or outlet ports.

For example, United States patent publication no. US20210270257, published on Sep. 2, 2021, disclosed fluid compressors for pumping multiphase fluids. A representative view of a compressor 100 disclosed therein is shown in FIG. 1. Compressor 100 includes a compression cylinder 102 having opposite ends 112*a*, 112*b*. The compression cylinder 100 has a double-acting compression piston for compressing a fluid towards one or the other of the two ends 112*a*, 112*b*. The compression piston is driven by two hydraulic cylinders each coupled to the compression cylinder at one of the ends 112*a*, 112*b* through a central port. Each end 112*a*, 112*b* also has two fluid ports 104*a*, 104*b* spaced from the central port, one of which is an inlet port and the other of which is an outlet port. The fluid to be pumped can flow in and out of compression cylinder 102 through ports 104*a* and ports 104*b*. Each port 104*a*,104*b* is connected to a check valve 108*a*, 108*b* by an elbow connector 106*a*, 106*b*. The elbow connectors 106*a*,106*b* are used and have sufficient size so that the check valves 108*a*, 108*b* are offset from the hydraulic cylinders at each end 112*a*, 112*b* of the compression cylinder 100. The check valves 108*a*,108*b* are connected by flanges and pipes to the fluid input source and the output destination. The check valves 108*a*, 108*b* are configured and oriented to control the fluid flow at the ports 104*a*, 104*b*.

It is desirable to improve the efficiency or performance of such fluid compressors.

SUMMARY

In an embodiment, the present disclosure relates to a compressor that comprises a first cylinder for compressing a fluid. The first cylinder comprises a chamber configured to receive a fluid and having a first end and a second end, a piston reciprocally movable in the chamber for alternately compressing the fluid towards the first or second end, three or more first ports at the first end of the chamber, the first ports comprising at least one first inlet port and at least one first outlet port, and three or more second ports at the second end of the chamber, the second ports comprising at least one second inlet port and at least one second outlet port. Each one of the first and second ports defines a fluid flow path extending along an axial direction of the port. The compressor also comprises at least one second cylinder each connected and configured to drive movement of the piston in the first cylinder through one of the first and second ends and a plurality of check valves, each associated with one of the first and second ports and connected inline with the associated port along the axial direction of the associated port. The piston is reciprocally movable in the chamber along an axial direction of the chamber, and the axial directions of the first and second ports are parallel to the axial direction of the chamber.

In some embodiments the check valves connected to the inlet ports are oriented to allow the fluid to flow into the compression chamber through the inlet ports and the check valves connected to the outlet ports are oriented to allow fluid to flow out of the compression chamber through the outlet ports.

In some embodiments, the first ports comprise at least two inlet ports, and the second ports comprise at least two inlet ports. In some embodiments, the first ports comprise at least two outlet ports, and the second ports comprise at least two outlet ports.

In at least some of the embodiments presented herein, the compressor further comprises a plurality of first conduits each connecting one of the check valves to its associated port. In some embodiments, each one of the first conduits defines a straight fluid path between the check valve and the port connected by the respective first conduit.

In some embodiments, the check valves connected to the inlet ports are first check valves and the check valves connected to the outlet ports are second check valves and the compressor further comprises a second conduit connected to the first check valves for connecting a fluid source to the inlet ports to supply the fluid from the fluid source to the compression chamber though the inlet ports, and a third conduit connected to the second check valves for receiving compressed fluid from the compression chamber through the outlet ports.

In some embodiments, each of the second and third conduits comprises a first end comprising a first flange, a plurality of second ends each comprising a second flange for connecting the respective second end to one of the check valves and at least one third end comprising a third flange and a removable blanking plate coupled to the third flange.

In some embodiments, the first ports comprise two first inlet ports and two first outlet ports, and the second ports comprise two second inlet ports and two second outlet ports.

In some embodiments, the at least one first inlet port is positioned above the at least one first outlet port, and the at least one second inlet port is positioned above the at least one second outlet port.

In some embodiments, the check valves are in-line check valves.

In another embodiment, the present disclosure relates to a compressor that comprises a first cylinder for compressing a fluid. The first cylinder comprises a chamber configured to receive a fluid and having a first end and a second end, a piston reciprocally movable in the chamber along an axial direction of the chamber for alternately compressing the fluid towards the first or second end, a plurality of first inlet ports and a plurality of first outlet ports at the first end of the chamber and a plurality of second inlet ports and a plurality of second outlet ports at the second end of the chamber. Each one of the inlet and outlet ports defines a fluid flow path extending along an axial direction of the port, the axial directions of the inlet and outlet ports being perpendicular to the axial direction of the chamber. The compressor also comprises at least one second cylinder each connected and configured to drive movement of the piston in the first cylinder through one of the first and second ends and a plurality of check valves, each associated with one of the inlet and outlet ports and connected inline with the associated port along the axial direction of the associated port.

In some embodiments, the first inlet ports are positioned above the first outlet ports at the first end of the chamber and the second inlet ports are positioned above the second outlet ports at the second end of the chamber.

In some embodiments, the plurality of check valves are in-line check valves.

In some embodiments, the compressor further comprises a plurality of first conduits each connecting one of the check valves to its associated port. In some embodiments, each one of the first conduits defines a straight fluid path between the check valve and the port connected by the respective first conduit.

In another embodiment, the present disclosure relates to a system for compressing a fluid, comprising first and second compressors each as defined herein. The first and second compressors are connected such that the compressed fluid from the outlet ports of the first compressor is fed into the inlet ports of the second compressor for further compression.

BRIEF DESCRIPTION OF THE DRAWINGS

In the figures, which illustrate example embodiments.

DETAILED DESCRIPTION

Figure 1:
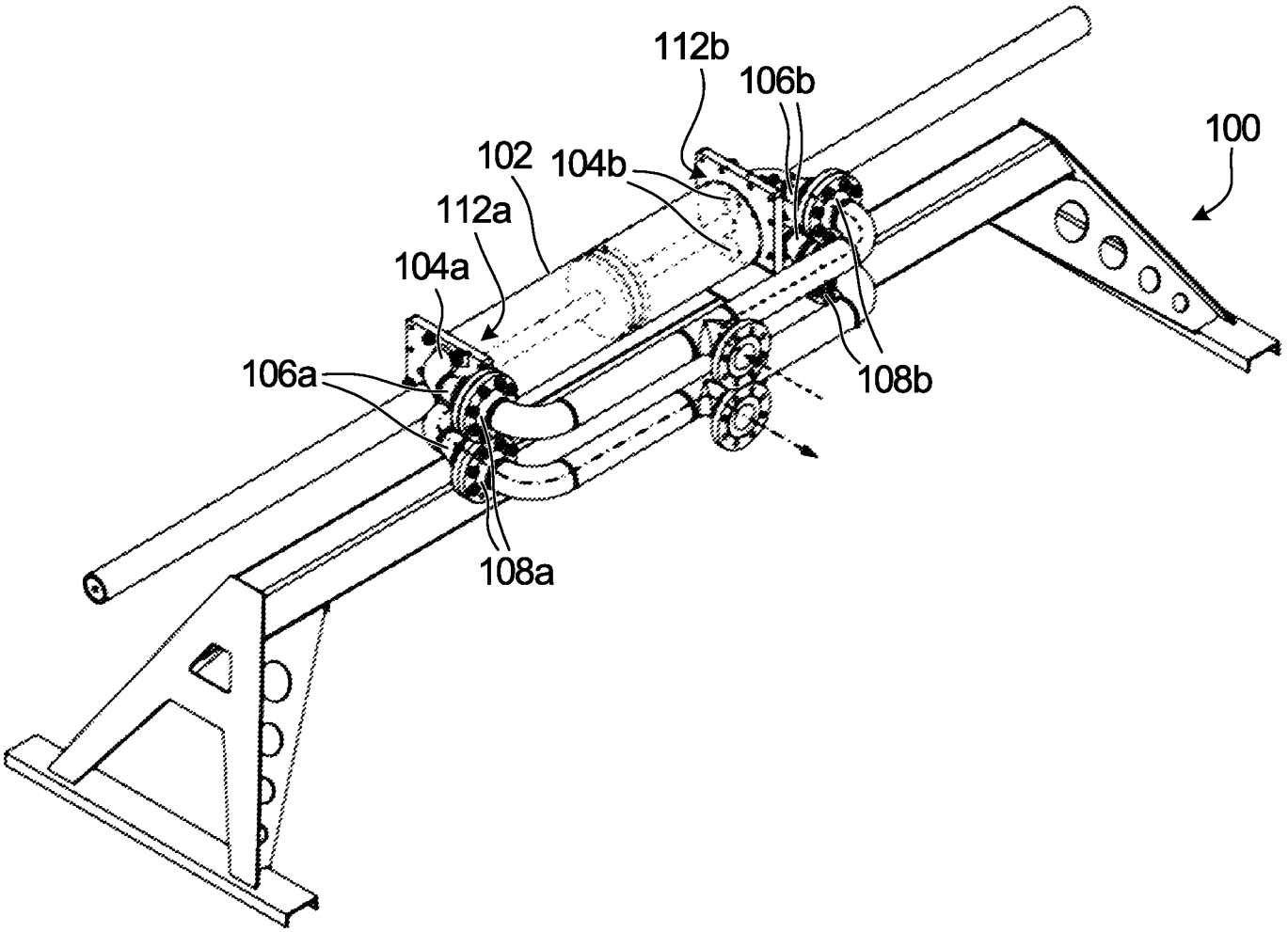
FIG. 1 PRIOR ART
FIG. 1 is a front perspective view of a comparison compressor.

It has been recognized that when the compression piston within the compression chamber of the compressor 100 as shown in FIG. 1 reaches an end of stroke position, a relatively large dead volume (or minimal chamber volume) still undesirably remains within the space between the piston face and the check valves 108*a* or 108*b*, particularly in the ports 104*a* or 104*b* and the elbow connectors 106*a* or 106*b*. This large dead volume leads to decreased pumping efficiency and performance. This problem would be exaggerated when the sizes of the elbow connectors 106*a*, 106*b* and the check valves 108*a*, 108*b* are increased to provide increased throughput or to pump certain liquids such as liquids produced from a well in oil and gas applications. It is thus desirable to provide a fluid compressor with reduced dead volume to increase the compression ratio of the compressor without reducing or limiting the pumping throughput.

The present inventor has discovered a number of solutions to address the above problem. First, connecting a check valve to an inlet/outlet port without an elbow connector therebetween can provide a straight, shortened fluid flow path between the port and the check valve, thus reducing the dead volume. The straight flow path will also improve the flow characteristics in the flow path, thereby increasing pumping efficiency.

As can be appreciated, when the elbow connector between the check valve and the port is eliminated or replaced with a straight connector, the check valve can be positioned closer to the port, reducing the path volume between the end of the piston and the check valve. This will beneficially reduce the dead volume (i.e., the volume of compressed fluid retained within the compressor at the end of each stroke) of the compressor. With a smaller dead volume, the compressor will be able to draw in, compress and expel a larger volume of liquid on each stroke, and provide a higher compression ratio on each stroke.

Due to the limited room at each end of the compression cylinder in the presence of the hydraulic cylinder coupled to the compression cylinder, the sizes of the inlet and outlet ports and the check valves are constrained, which in turn limits the fluid throughput. However, the present inventor realized that three or more fluid communication ports may be provided at each end of the compressor to increase the fluid throughput. For example, at least two of the end ports may be inlet ports, or at least two of the end ports may be outlet ports. In some embodiments, two inlet ports and two outlet ports may be provided at each end of the compressor.

The multiple inlet or outlet ports can be sized and arranged so they are offset from the hydraulic cylinder at the same end.

Accordingly, an example embodiment herein relates to a compressor for receiving a fluid supply, compressing the fluid and then moving the fluid to another location. The fluid may be a gas, a liquid or a multiphase fluid that comprises 100% gas, 100% liquid, or any proportion of gas/liquid therebetween. The compressor may include a compression chamber configured to receive a fluid which is compressed towards a first end or a second end of the compression chamber by a piston that is reciprocally moveable along an axial direction. The first and second ends of the chamber may each include three or more ports for fluid communication. At least one first inlet port at the first end of the compression chamber and at least one second inlet port at the second end of the compression chamber are configured to allow fluid to enter the compression chamber. The compressor may also include at least one first outlet port at the first end of the compression chamber and at least one second outlet port at the second end of the compression chamber, both configured to allow fluid to exit the compression chamber. Movement of the piston may be driven by at least one second cylinder connected to the piston within the first cylinder. The compressor may also include a plurality of check valves, each connected to one of the inlet and outlet ports, inline with the respective port along the axial direction. The position and alignment of the check valves relative to their respective port reduces dead volume and provides a straight flow path for fluid in and out of the compression chamber.

In an embodiment the check valves are oriented to be aligned with the axial direction of movement of the piston within the compression chamber. In a further embodiment, the check valves are perpendicular to the axial direction of movement of the piston within the compression chamber.

In an embodiment, the compressor may have two first inlet ports at the first end of the compression chamber and two second inlet ports at the second end of the compression chamber. The compressor may also include two first outlet ports at the first end of the compression chamber and two second outlet ports at the second end of the compression chamber. These ports may advantageously increase space at each end of the compressor for additional components to be accommodated such as for example, different sizes of hydraulic cylinders to drive movement of the piston.

In an embodiment, a first compressor may be configured to be connected to a second compressor. The first compressor may compress a fluid to a first pressure P1 and the second compressor may further compress the fluid to a second higher pressure P2.

The compressors may be configured to be operable to transfer multiphase mixtures of substances that comprise 100% gas, 100% liquid, or any proportion of gas/liquid therebetween, wherein during operation, the ratio of gas/liquid is changing, either intermittently, periodically, or substantially continuously. The compressors can also handle fluids that may also carry abrasive solid materials such as sand without damaging important components of the compressor system such as the surfaces of various cylinders and pistons.

Figure 2A:
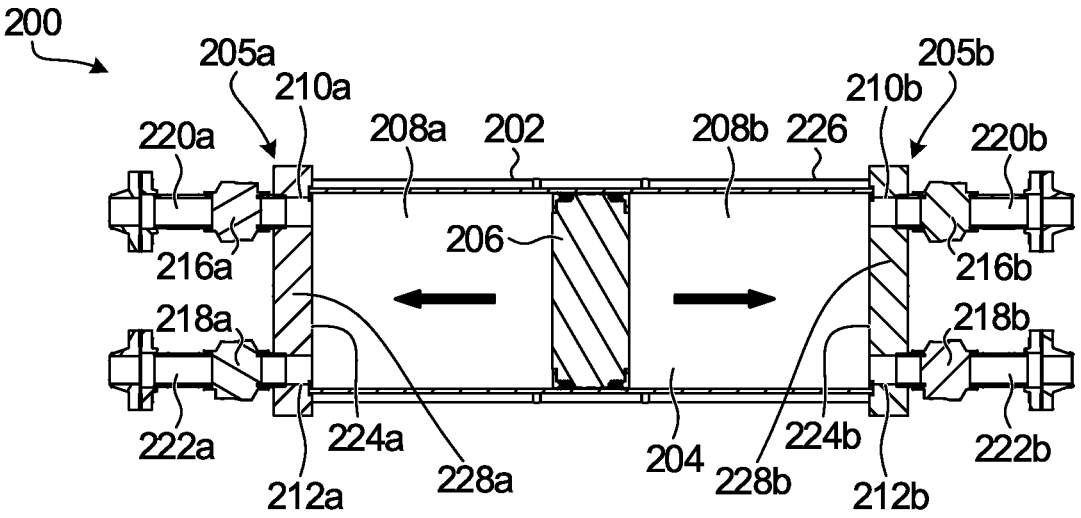
FIG. 2A is a schematic cross-sectional view of a simplified compressor, according to an example embodiment.

An example compressor 200 is schematically illustrated in FIG. 2A. As depicted, compressor 200 may include first cylinder 202 for compressing a fluid. First cylinder 202 may include tubular wall 226 with first and second end plates 228*a*, 228*b* at either end. The inner surface of tubular wall 226 and the inner surfaces of end plates 228*a*, 228*b* define compression chamber 204, which has first end 205*a* and second end 205*b*. Piston 206 may be reciprocally moveable within compression chamber 204 in an axial direction towards first end 205*a* or second end 205*b* as indicated by the arrows in FIG. 2A. Piston 206 divides compression chamber 204 into two adjacent first and second compression chamber sections 208*a*, 208*b*. At first end 205*a* of compression chamber 204 there may be two ports 210*a*, 212*a* configured to allow fluid to flow into and out of compression chamber section 208*a*. As shown in FIG. 2A, ports 210*a*, 212*a* may be cylindrical linear channels extending from the outer vertical side to the inner vertical side of plate 228*a*. At second end 205*b* there may be two ports 210*b*, 212*b* configured to allow fluid to flow into and out of compression chamber section 208*b*. As shown in FIG. 2A, ports 210*b*, 212*b* may be cylindrical linear channels extending from the outer vertical side to the inner vertical side of plate 228*b*. To each of ports 210*a*, 210*b*, 212*a*, 212*b*, respective check valves 216*a*, 216*b*, 218*a*, 218*b* may be connected. Check valves 216*a*, 216*b*, 218*a*, 218*b*, may be any suitable check valve, also known as a non-return valve, reflux valve, foot valve or one way valve, and are configured to move between an open configuration and a closed configuration. When in a closed configuration fluid flow is not permitted in either direction through the check valve. When in an open configuration, the check valves allow fluid to flow through in one direction only from an inlet side to an outlet side of the check valve. The check valve may switch from a closed configuration to an open configuration when the pressure is greater on the inlet side of the port than the outlet side, creating a pressure differential across the check valve. Once the pressure differential reaches a pre-determined value, known as the threshold pressure (also known as the cracking pressure), the check valves are configured to open, permitting fluid flow from the inlet side to the outlet side only. The check valves may be operable to be adjustable such that the threshold pressure that causes the check valve to open may be set at a desired value. The check valves are configured to switch from the open configuration back to the closed configuration, preventing fluid flow therethrough once the pressure differential drops to a lower pressure, known as the reseal pressure.

Check valves 216*a*, 216*b*, 218*a*, 218*b* may be any suitable type as is known in the art. For example, the check valves may be ball check valves, diaphragm check valves, swing check valves, lift check valves, in-line check valves or reed valves. In a specific embodiment, check valves 216*a*, 216*b*, 218*a*, 218*b* may be a threaded in-line check valve such as a 3" SCV Check Valve made by DFT Inc.

Check valves 216*a*, 216*b*, 218*a*, 218*b* may be connected to their respective ports 210*a*, 210*b*, 212*a*, 212*b* by any suitable method. For example, check valves 216*a*, 216*b*, 218*a*, 218*b* may have threaded fittings at either end configured to engage with corresponding threaded fittings at the outer end of ports 210*a*, 210*b*, 212*a*, 212*b*. In other embodiments, check valves 216*a*, 216*b*, 218*a*, 218*b* may be configured to be partially inserted into their respective ports 210*a*, 210*b*, 212*a*, 212*b* and secured by a suitable method such as welding.

The orientation of check valves 216*a*, 216*b*, 218*a*, 218*b* relative to ports 210*a*, 210*b*, 212*a*, 212*b* will determine if each port functions as an inlet port or an outlet port. As depicted in FIG. 2A, check valves 216*a*, 216*b* may be oriented such that ports 210*a*, 210*b* operate as inlet ports to supply fluid to compression chamber 204. This is achieved by connecting the outlet side of check valve 216*a* to the outer end of port 210*a* such that, when check valve 216*a* is in an open configuration, fluid is only permitted to flow into chamber section 208*a* through port 210*a*. Fluid is prevented from flowing out of chamber section 208*a* through check valve 216*a* at all times by the orientation of check valve 216*a*.

Similarly, the outlet side of check valve 216*b* may be connected to the outer end of port 210*b* such that, when check valve 216*b* is in an open configuration, fluid is only permitted to flow into chamber section 208*b* through port 210*b*. Fluid is prevented from flowing out of chamber section 208*b* through check valve 216*b* at all times by the orientation of check valve 216*b*.

Check valves 218*a*, 218*b* may be oriented such that ports 212*a*, 212*b* operate as outlet ports to remove fluid from compression chamber 204. The inlet side of check valve 218*a* may be connected to the outer end of port 212*a* such that, when check valve 218*a* is in an open configuration, fluid is only permitted to flow from chamber section 208*a* through port 212*a*. Fluid is prevented from flowing into chamber section 208*a* through check valve 218*a* at all times by the orientation of check valve 218*a*.

Similarly, the inlet end of check valve 218*b* may be connected to the outer end of port 212*b* such that, when check valve 218*b* is in an open configuration, fluid is only permitted to flow from chamber section 208*b* through port 212*b*. Fluid is prevented from flowing into chamber section 208*b* through check valve 218*b* at all times.

A pair of inlet conduits 220*a*, 220*b* may be connected to respective check valves 216*a*, 216*b* to supply fluid from a fluid source and a pair of outlet conduits 222*a*, 222*b* may be connected to respective check valves 218*a*, 218*b*, to receive compressed fluid from check valves 218*a*, 218*b*. In the embodiment shown in FIG. 2A, check valves 216*a*, 216*b*, 218*a*, 218*b* may be positioned inline with their respective ports 210*a*, 210*b*, 212*a*, 212*b* in the axial direction, which are in turn positioned inline with the axial direction of movement of piston 206.

Figure 2B:
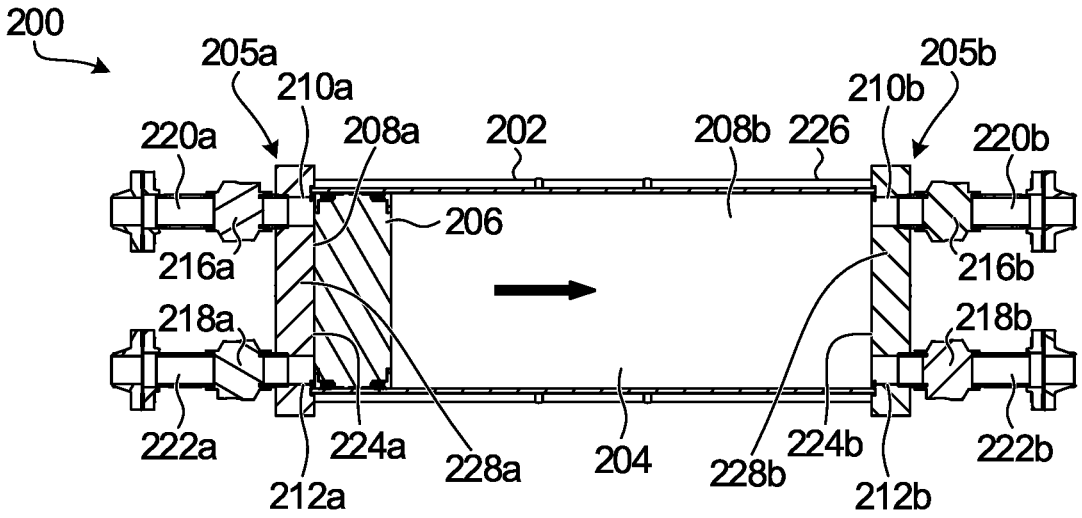
FIG. 2B is a schematic view of the compressor of FIG. 2A in operation at a first state.
Figure 2C:
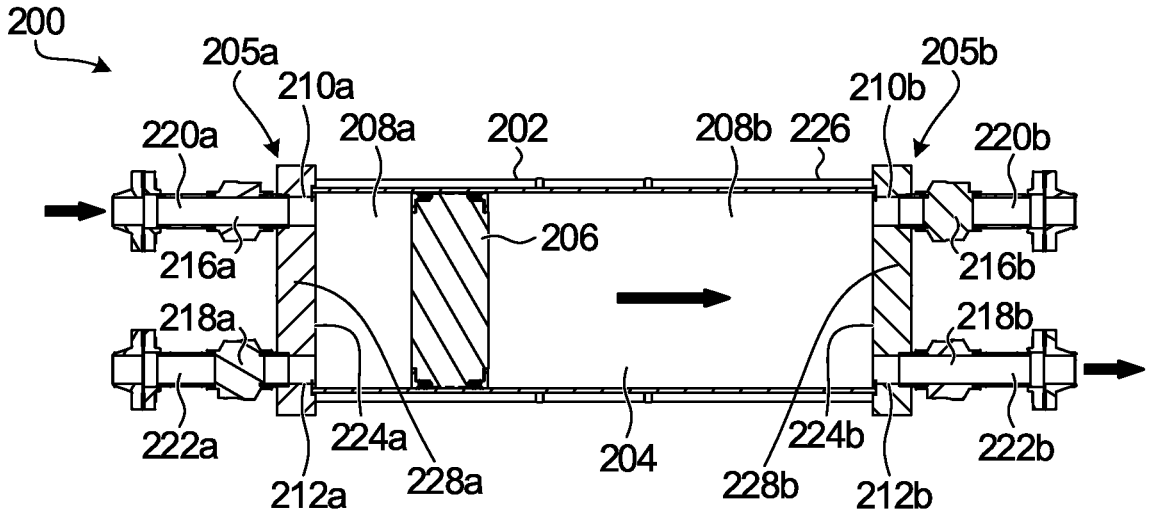
FIG. 2C is a schematic view of the compressor of FIG. 2A in operation at a second state.
Figure 2D:
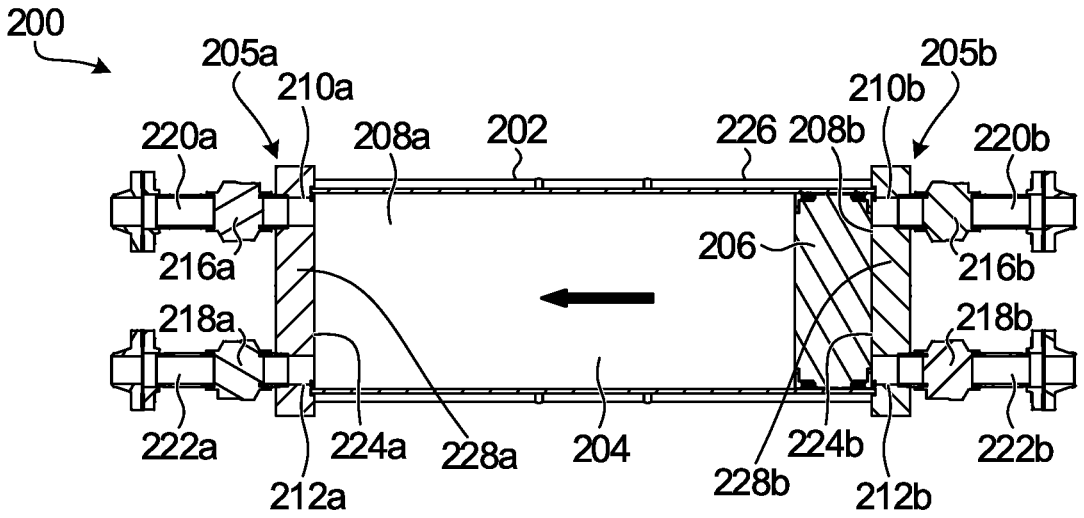
FIG. 2D is a schematic view of the compressor of FIG. 2A in operation at a third state.
Figure 2E:
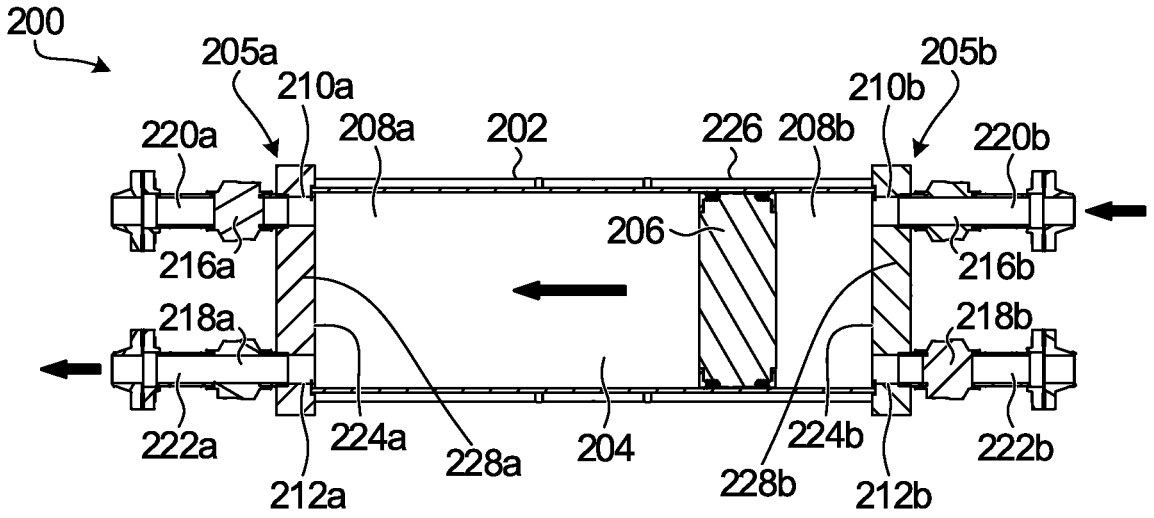
FIG. 2E is a schematic view of the compressor of FIG. 2A in operation at a fourth state.
Figure 3A:
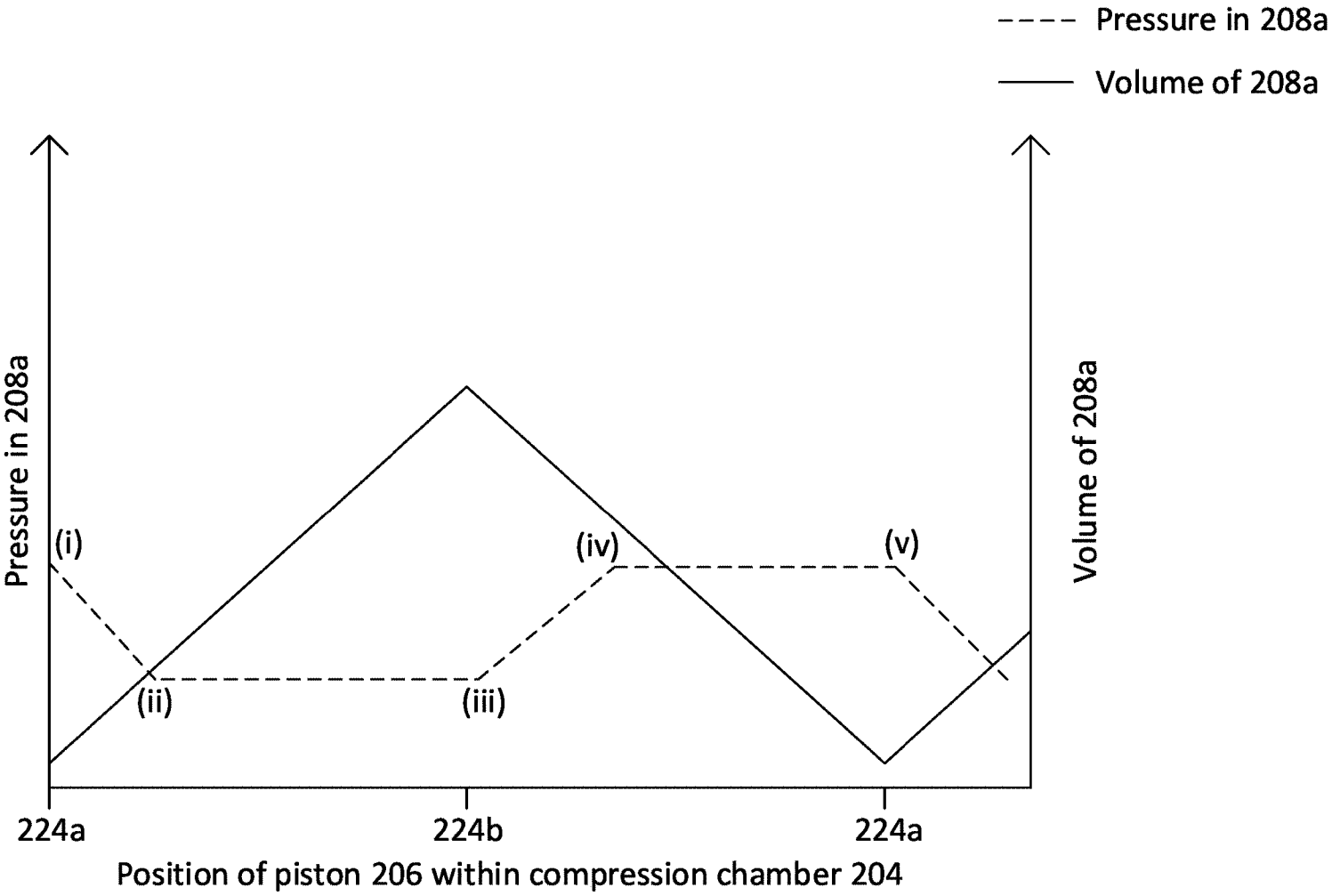
FIG. 3A is a line graph illustrating schematically the changes in the fluid volume and pressure between an end of the compression chamber and the piston during a piston stroke in the compressor of FIG. 2A.
Figure 3B:
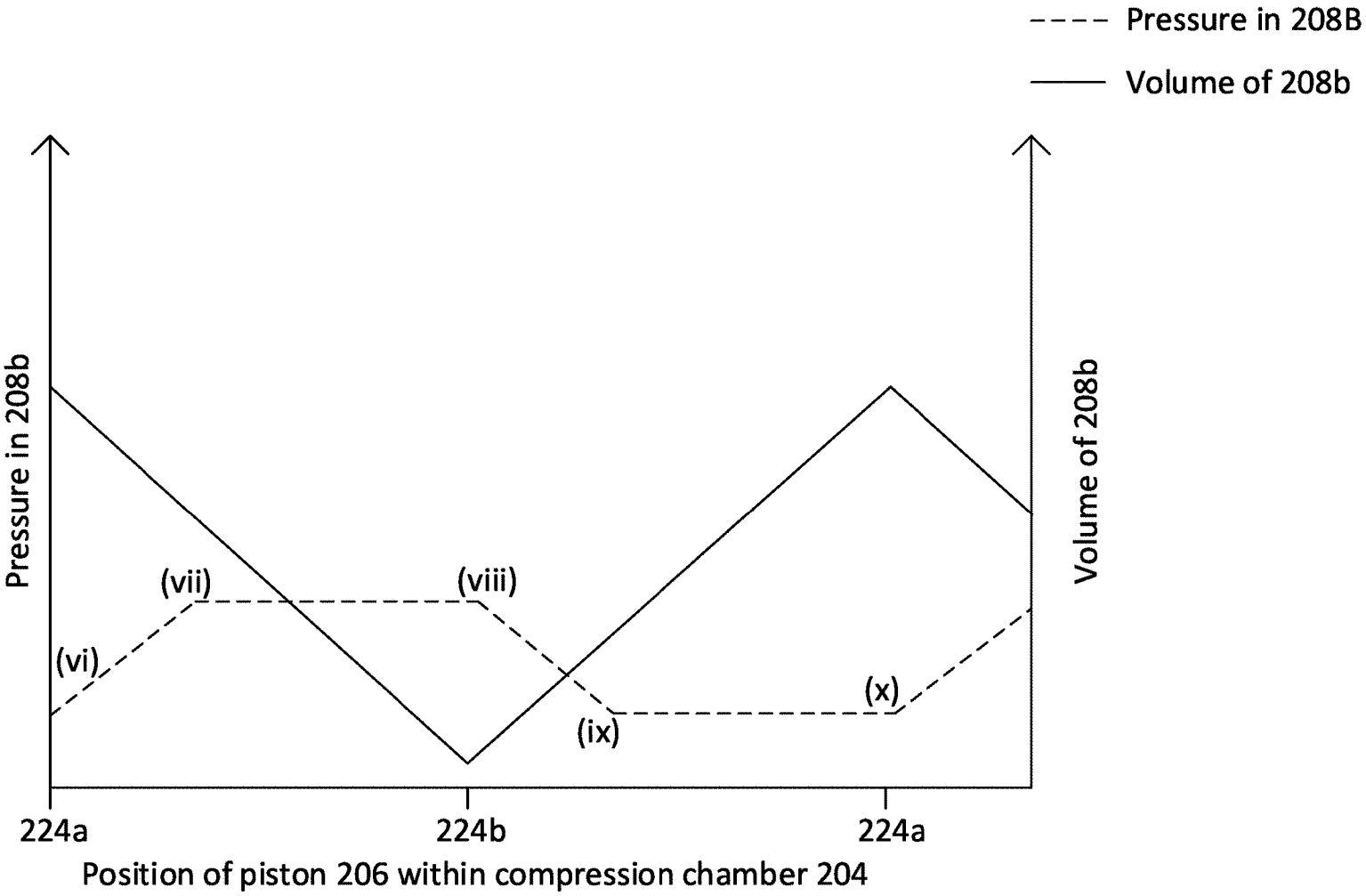
FIG. 3B is a line graph illustrating schematically the changes in the fluid volume and pressure between another end of the compression chamber and the piston during a piston stroke in the compressor of FIG. 2A.

With reference to FIGS. 2B to 2E, piston 206 may reciprocally move between first end of stroke position 224*a* at first end 205*a* of compression chamber 204 (shown in FIG. 2B) and second end of stroke position 224*b* at second end 205*b* of compression chamber 204 (shown in FIG. 2D). FIGS. 3A and 3B depict the change in volume of compression chamber sections 208*a*, 208*b* with the position of piston 206. With reference to FIG. 3A, when piston 206 is at position 224*a*, the volume of first compression chamber 208*a* is at a minimum volume (also referred to as the dead volume) and increases to a maximum volume once piston 206 reaches second end of stroke position 224*b*. As piston 206 returns to first end of stroke position 224*a*, the volume of first compression chamber will decease back to the minimum volume.

Similarly, as shown in FIG. 3B, the volume of second compression chamber 208*b* will increase from a minimum volume at the second end of stroke position 224*b* to a maximum volume at the first end of stroke position 224*a*.

As check valves 216*a*, 216*b*, 218*a*, 218*b* are positioned inline with their respective ports 210*a*, 210*b*, 212*a*, 212*b*, they may be positioned closer to their respective port. This will beneficially reduce the path volume between check valves 216*a*, 218*a* and piston 206 when piston 206 is first end of stroke position 224*a* and between check valves 216*b*, 218*b* and piston 206 when piston 206 is second end of stroke position 224*b*. As such, the dead volumes in the compressors shown in FIGS. 3A and 3B are less than that of the comparative compressor shown in FIG. 1.

As will be explained below, as piston 206 reciprocates within compression chamber 204, fluid may alternately enter, and exit each of the compression chamber sections 208*a*, 208*b*. Flow of fluid in and out of each compression chamber section 208*a*, 208*b* is controlled by the state of each of the check valves attached to the ports. One complete cycle of compressor 200 is illustrated in FIGS. 2B to 2D, with direction of fluid flow at each stage indicated. Piston 206 may start at first end of stroke position 224*a* shown in FIG. 2B and move, via the intermediate position shown in FIG. 2C to second stroke position 224*b* shown in FIG. 2D. Piston 206 may then reverse direction from second end of stroke position 224*b* and return to first end of stroke position shown in FIG. 2B, via the intermediate position shown in FIG. 2E. The change in volume and representative examples for the variation in pressure of first and second compression chambers 208*a*, 208*b* are shown in FIGS. 3A and 3B respectively.

Turning first to FIG. 2B, piston 206 is shown at first end of stroke position 224*a*. Check valves 216*a*, 216*b*, 218*a*, 218*b* are all closed such that fluid cannot flow into or out of first or second compression chamber sections 208*a*, 208*b*. Fluid will already be located in first and second compression chamber sections 208*a*, 208*b* having previously been drawn in during previous strokes.

As piston 206 moves in direction indicated by the arrow in FIG. 2B, the pressure in first compression chamber section 208*a* will drop as the volume increases (as shown between (i) and (ii) of FIG. 3A), causing a pressure differential to develop between the outer and inner sides of inlet check valve 216*a*. Once the differential pressure reaches the threshold pressure of valve 216*a*, valve 216*a* will open and fluid will flow from conduit 220*a* into first compression chamber section 208*a*, via inlet port 210*a* as shown in FIG. 2C. Once valve 216*a* is open, the pressure within first compression chamber section 208*a* will remain generally constant until piston 206 reaches the second end of stroke position 224*b*, (as shown between (ii) and (iii) of FIG. 3A). Once piston 206 reaches second end of stroke position 224*b* (FIG. 2D), valve 216*a* will close when the pressure differential between the outer and inner sides of valve 216*a* drops and reaches the reseal pressure of valve 216*a*.

At the same time, movement of piston 206 decreases the volume of second compression chamber 208*b* and increases the pressure within chamber section 208*b* as the fluid within chamber section 208*b* is compressed (as shown between (vi) to (vii) of FIG. 3B). This will cause a pressure differential to develop between the inner and outer side of outlet check valve 218*b*. Once the pressure differential reaches the threshold pressure of valve 218*b*, valve 218*b* will open and will flow out of second compression chamber section 208*b* and into conduit 222*b*, via outlet port 212*b*. Once valve 218*b* is open, the pressure within second compression chamber section 208*b* will remain generally constant (as shown between (vii) to (viii) of FIG. 3B) until piston 206 reaches second end of stroke position 224*b*. Once piston 206 reaches second end of stroke position 224*b* (FIG. 2D), valve 218*b* will close due to the pressure differential between the outer and inner sides of valve 218*b* dropping and reaching the reseal pressure of valve 218*b*.

Next, compressor 300 is configured for the return drive stroke. At second end of stroke position 224*b* shown in FIG. 2D, all check valves will be closed and with reference to (iii) of FIG. 3A, first compression chamber 208*a* will be at a maximum volume and contain fluid drawn in during the previous stroke. At the same time, with reference to (viii) of FIG. 3B, second compression chamber 208*b* will have its minimum volume and contain a volume of pressurised fluid (i.e. fluid at a higher pressure than the fluid in first compression chamber 208*a*).

As piston 206 moves in the direction indicated by the arrow in FIG. 2D, the pressure in second compression chamber section 208*b* will drop as the volume increases (as shown between (viii) and (ix) of FIG. 3B), causing a pressure differential to develop between the outer and inner sides of inlet check valve 216*b*. Once the differential pressure reaches the threshold pressure of valve 216*b*, valve 216*b* will open and fluid will flow from conduit 220*b* into first compression chamber section 208*b*, via inlet port 210*b* (FIG. 2E). Once valve 216*b* is open, the pressure within second compression chamber will remain generally constant until piston 206 reaches the first end of stroke position 224*a*, (as shown between (ix) and (x) of FIG. 3B). Once piston 206 reaches first end of stroke position 224*a* (FIG. 2B), valve 216*b* will close when the pressure differential between the outer and inner sides of valve 216*b* drops and reaches the reseal pressure of valve 216*b*.

At the same time, movement of piston 206 decreases the volume of first compression chamber 208*a* and increases the pressure in chamber section 208*a* as the fluid within is compressed (as shown between (iii) to (iv) of FIG. 3A). This will cause a pressure differential to develop between the inner and outer side of outlet check valve 218*a*. Once the pressure differential reaches the threshold pressure of valve 218*a*, valve 218*a* will open and will flow out of first compression chamber section 208*a* and into conduit 222*a*, via outlet port 212*a*. Once valve 218*a* is open, the pressure within first compression chamber section 208*a* will remain generally constant (as shown between (iv) to (v) of FIG. 3A) until piston 206 reaches first end of stroke position 224*a*. Once piston 206 reaches first end of stroke position 224*a* (FIG. 2B), valve 218*a* will close due to the pressure differential between the outer and inner sides of valve 218*a* dropping, reaching the reseal pressure of valve 218*a*.

The foregoing movement and compression of fluid within compression chamber 204 will continue as piston 206 continues to move between the first and second end of stroke positions 224*a*, 224*b*.

Figure 4:
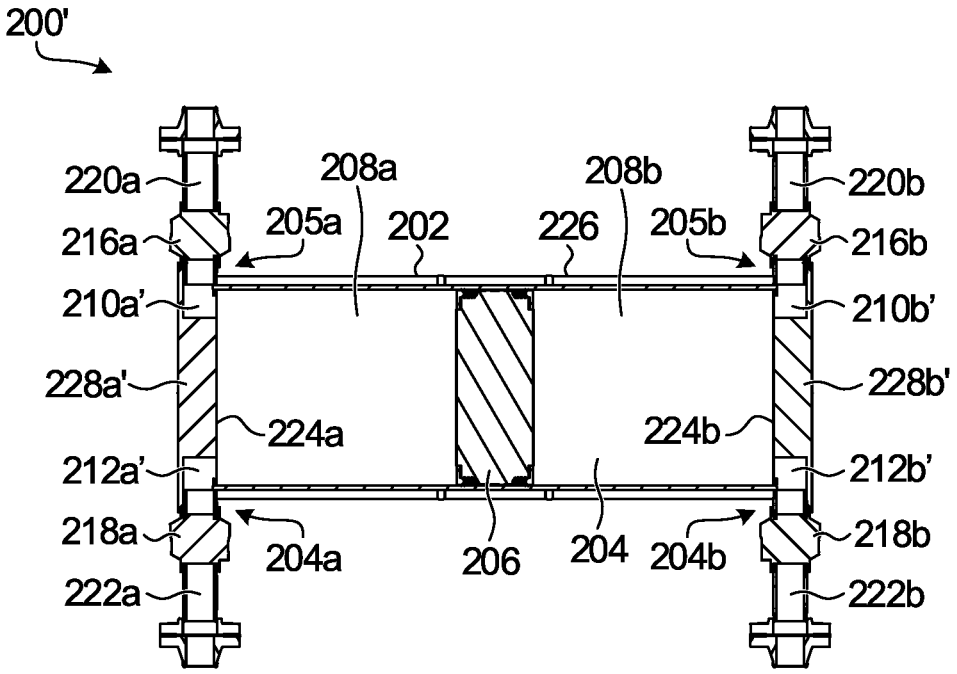
FIG. 4 is a schematic cross-sectional view of a simplified compressor, according to another example embodiment.

Turning to FIG. 4, an example compressor 200' according to another embodiment is shown schematically. Compressor 200' may be generally similar to compressor 200 as described above but in this embodiment, at either end of tubular wall 226 are first and second end plates 228*a*', 228*b*'. At first end 205*a* there may be two ports 210*a*', 212*a*' configured to allow fluid to flow into and out of first compression chamber section 208*a*. Ports 210*a*', 212*a*' may be cylindrical channels within plate 228*a*' extending from an outer side to an inner side of second end plate 228*a*'. Port 210*a*' may extend from the upper horizontal face to the inner vertical face of first end plate 228*a*'. Port 212*a*' may extend from the lower horizontal face to the inner vertical face of first end plate 228*a*'.

Similarly, at second end 205*b* there may be two ports 210*b*', 212*b*' configured to allow fluid to flow into and out of second compression chamber section 208*b*. Ports 210*b*', 212*b*' may be cylindrical channels within plate 228*b*' extending from an outer side to an inner side of second end plate 228*b*'. Port 210*b*' may extend from the upper horizontal face to the inner vertical face of first end plate 228*b*'. Port 212*b*' may extend from the lower vertical face to the inner vertical face of second end plate 228*b*'.

Similar to compressor 200, to each of ports 210*a*', 210*b*', 212*a*', 212*b*' respective check valves 216*a*, 216*b*, 218*a*, 218*b* may be connected. As the outer ends of ports 210*a*', 212*a*' are on the respective upper and lower faces of first end plate 228*a*' and the outer ends of ports 210*b*', 212*b*' are on the respective upper and lower faces of second end plate 228*b*', check valves 216*a*, 216*b*, 218*a*, 218*b* are positioned perpendicular to the axial direction of movement of piston 206.

As shown in FIG. 4, ports 210*a*', 210*b*', 212*a*', 212*b*' extend vertically though the respective end plate, before turning at 90 degrees inwards. In other embodiments, ports 210*a*', 210*b*', 212*a*', 212*b*' may follow any other suitable path, such as a curved path.

Figure 5A:
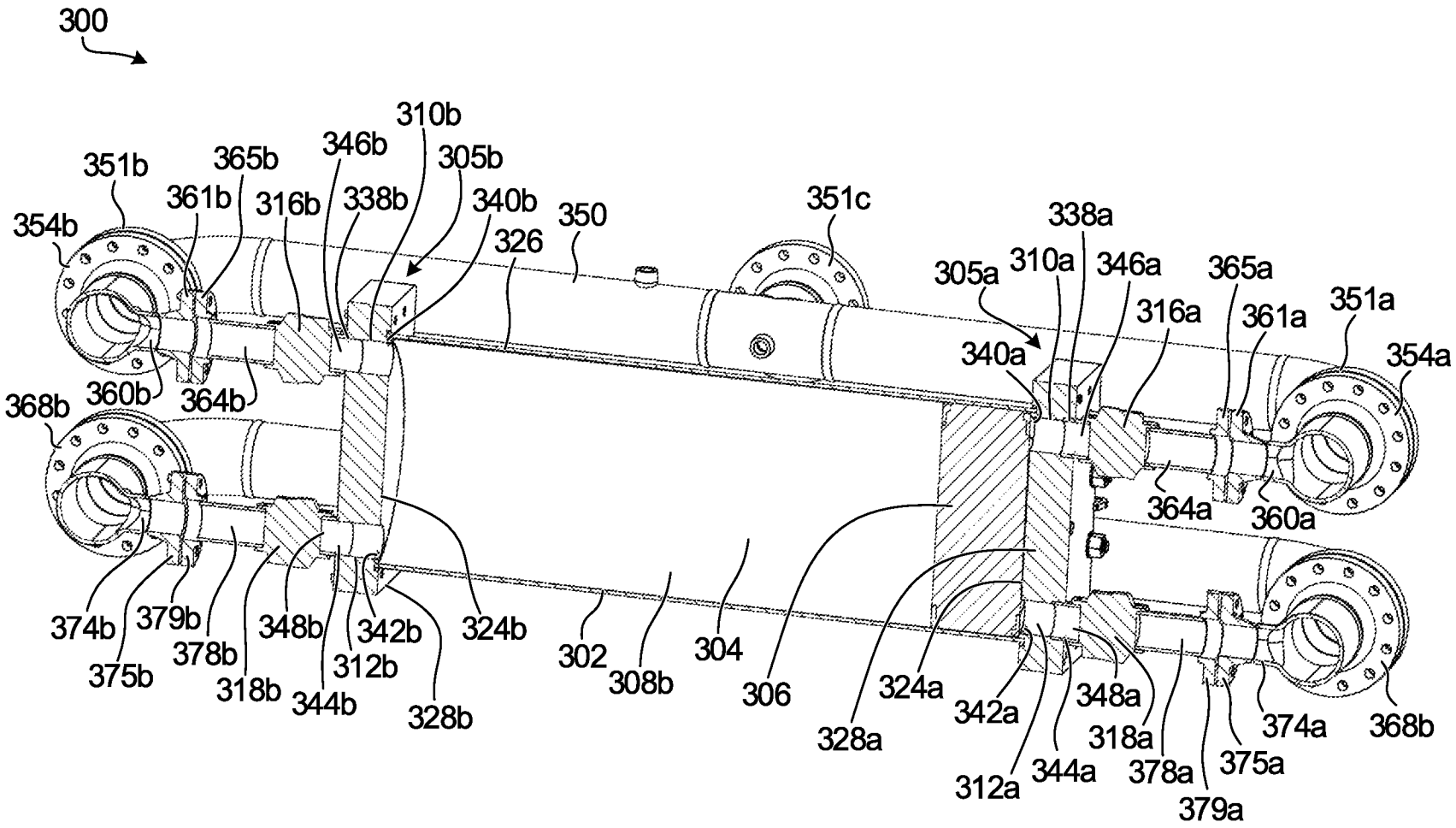
FIG. 5A is a cross-sectional rear perspective view of a compressor according to a further example embodiment.
Figure 5B:
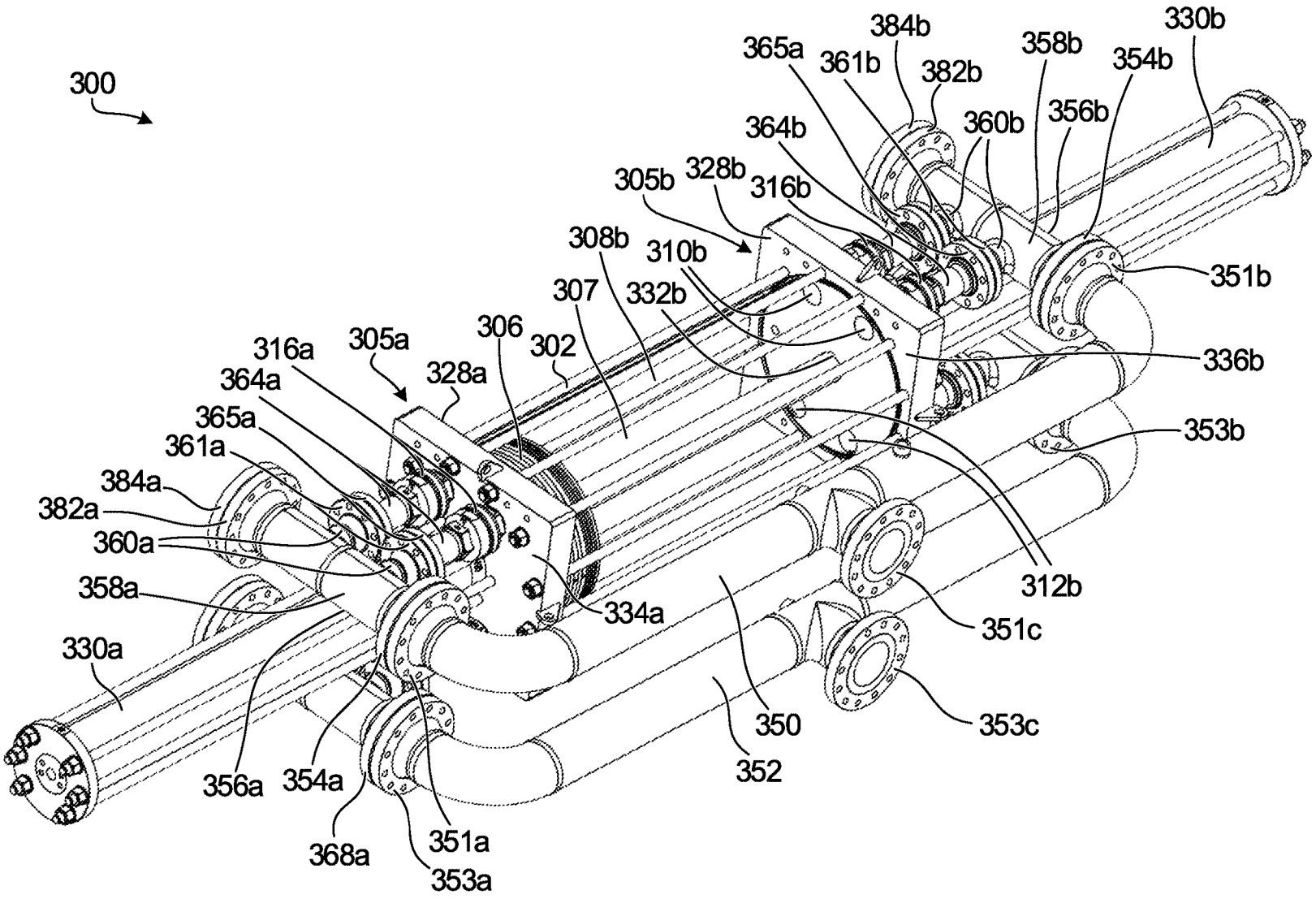
FIGS. 5B and 5C are partially transparent, front perspective views of the compressor of FIG. 5A.
Figure 5C:
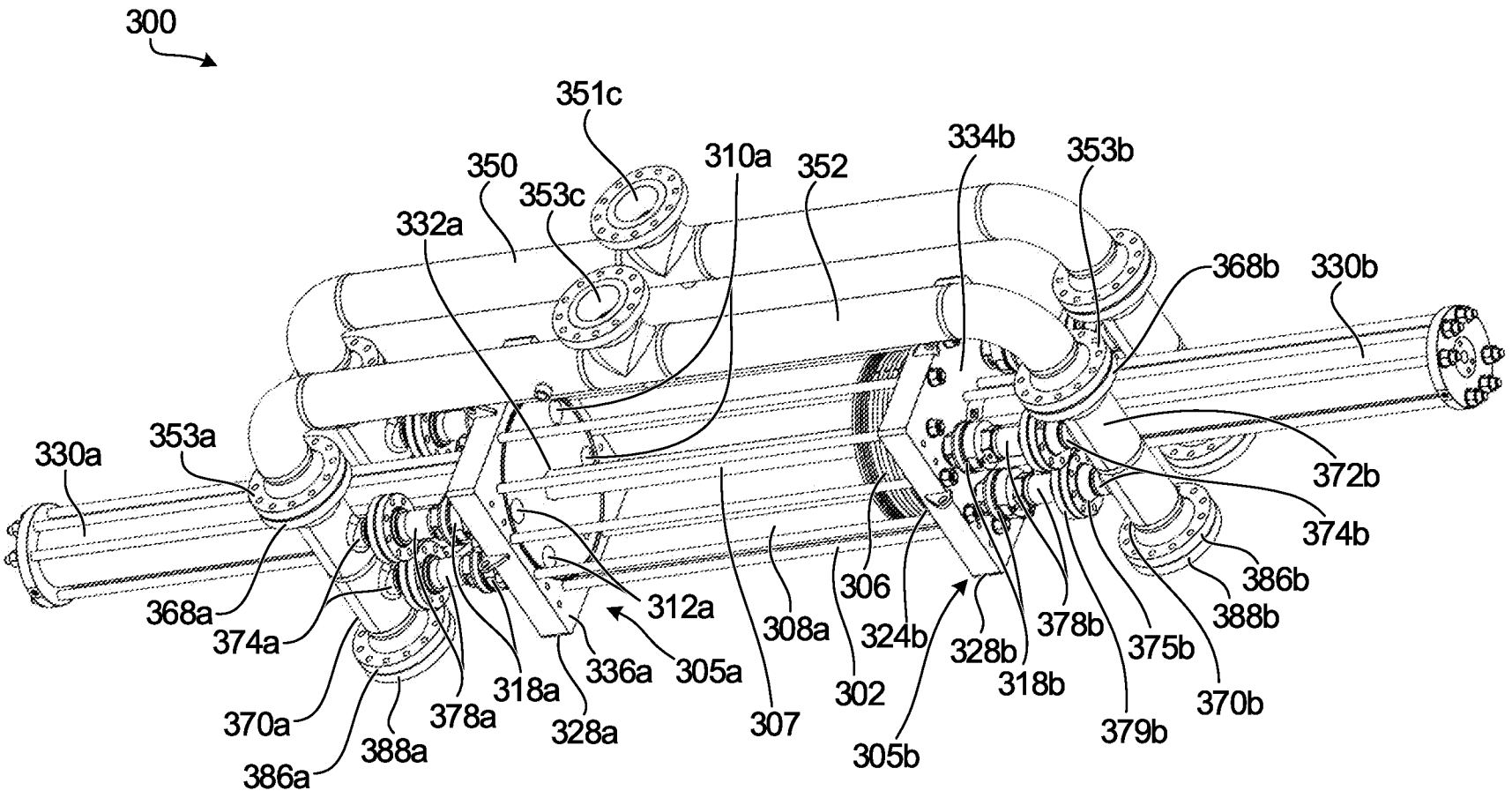

FIGS. 5A to 5I illustrate a compressor 300, which is an example embodiment of compressor 200. Compressor 300 may include first cylinder 302 for compressing a fluid within compression chamber 304 having first end 305*a* and second end 305*b* (FIG. 5A). First cylinder 302 may include cylinder barrel/tubular wall 326 positioned between first and second cylinder head plates 328*a*, 328*b* at respective first and second ends 305*a*, 305*b* of compression chamber 304. First cylinder 302 may also include piston 306, reciprocally moveable within compression chamber 304 in an axial direction towards first end 305*a* or second end 305*b*. Piston 306 may divide compression chamber 302 into two adjacent compression chamber sections 308*a* (FIG. 5C), 308*b* (FIG. 5B). First compression chamber section 308*a* may be defined by the interior surface of tubular wall 326, a surface of piston 306 and the inner face 336*a* of first head plate 328*a* (FIG. 5C). Second compression chamber section 308*b* may be formed on the opposite side of piston 306 to first compression chamber section 308*a* and may be defined by the interior surface of tubular wall 326, a surface of piston 306 and the inner face 336*b* of second head plate 328*b* (FIG. 5B).

Piston 306 may be reciprocally moveable within first cylinder 302 between a first end of stroke position 324*a* (FIGS. 5A and 5B) and second end of stroke position 324*b* (FIG. 5C). The end of stroke positions may be a physical end of stroke positions whereby for a physical first end of stroke position, the surface of piston 306 will contact the inner face 336*a* of first head plate 328*a*. Likewise, for a physical second end of stroke position, the surface of piston 306 will contact the inner face 336*b* of second head plate 328*b*. More desirably, for example to reduce noise and wear on components of compressor 300 during operation, the end of stroke positions are pre-defined end of stroke positions selected such that when piston 306 is almost at the physical end of stroke position, but not yet in contact with first or second head plates 328*a*, 328*b*. For example, in an embodiment, a pre-defined end of stroke position may be 0.5" away from first or second head plates 328*a*, 328*b*.

Compressor 300 may also include first and second, one way acting, hydraulic cylinders 330*a*, 330*b* (FIG. 5B) positioned at opposite ends of compressor 300. Hydraulic cylinders 330*a*, 330*b* may each include a hydraulic piston therewithin, each connected to opposite ends of piston rod 307 and each configured to provide a driving force that acts in an opposite direction to each other, both acting inwardly towards each other and towards first cylinder 302, thus driving reciprocal movement of piston 306.

First cylinder 302 and hydraulic cylinders 330*a*, 330*b* may have generally circular cross-sections although alternately shaped cross sections are possible in some embodiments.

With reference to FIG. 5C, first head plate 328*a* may have a generally square or rectangular shape with a pair of upper first inlet ports 310*a*, a pair of lower first outlet ports 312*a* and centrally located piston rod opening 332*a*. First inlet ports 310*a* and first outlet ports 312*a* may be circular openings that extend through first head plate 328*a* from outer face 334*a* to inner face 336*a* of first head plate 328*a*. Similarly, with reference to FIGS. 5B and 5H, second head plate 328*b* may have a generally square or rectangular shape with a pair of upper second inlet ports 310*b*, a pair of lower second outlet ports 312*b* and centrally located piston rod opening 332*b*. Second inlet ports 310*b* and second outlet ports 312*b* may be circular openings that extend through first head plate 328*b* from outer face 334*b* to inner face 336*b* of first head plate 328*b*.

First inlet ports 310*a* are configured to receive fluid at outer first end 338*a* and communicate fluid to inner second end 340*a* inside first chamber section 308*a* (FIG. 5A). Similarly, second inlet ports 310*b* are configured to receive fluid at outer first end 338*b* and communicate fluid to an inner, second end 340*b* inside second chamber section 308*b* (FIG. 5A).

First outlet ports 312*a* are configured to receive fluid from first chamber section 308*a* at inner first end 342*a* and communicate fluid to outer second end 344*a*. Similarly, second outlet ports 312*b* are configured to receive fluid from second chamber section 308*b* at inner first end 342*b* and communicate fluid to outer second end 344*b*.

Connected to each of first ends 338*a*, 338*b* of inlet ports 310*a*, 310*b* may be respective inlet check valves 316*a*, 316*b* configured to ensure that fluid may flow into compression chamber 304 from inlet ports 310*a*, 310*b* (i.e., fluid only travels from first ends 338*a*, 338*b* to second ends 340*a*, 340*b*). In some embodiments, inlet check valves 316*a*, 316*b* may be connected directly to first ends 338*a*, 338*b* of inlet ports 310*a*, 310*b*. In the embodiment shown in FIG. 5A, short conduits 346*a*, sized to be partially received within first ends 338*a* of inlet ports 310*a*, may be disposed between inlet check valve 316*a* and first inlet ports 310*a* to facilitate connection of check valves 316*a*. Similarly, short conduits 346*b*, sized to be partially received within first ends 338*b* of inlet ports 310*b*, may be disposed between inlet check valve 316*b* and second inlet port 310*b* to facilitate connection of check valve 316*b*.

Similarly, connected to each of the second ends 344*a*, 344*b* of outlet ports 312*a*, 312*b* may be respective outlet check valves 318*a*, 318*b* configured to ensure that fluid may only flow from compression chamber 304 into outlet ports 312*a*, 312*b*, (i.e., fluid only travels in the direction from first ends 342*a*, 342*b* to second ends 344*a*, 344*b*). In some embodiments, outlet check valves 318*a*, 318*b* may be connected directly to second ends 344*a*, 344*b* of outlet ports 312*a*, 312*b*. In the embodiment shown in FIG. 5A, short conduits 348*a*, sized to be partially received within second ends 344*a* of outlet ports 312*a*, may be disposed between outlet check valve 318*a* and first outlet port 312*a* to facilitate connection of check valve 318*a*. Similarly, short conduits 348*b*, sized to be partially received within second ends 344*b* of outlet ports 312*b*, may be disposed between outlet check valve 318*b* and second outlet port 312*b* to facilitate connection of check valve 318*b*.

Connections between ports 310*a*, 310*b*, 312*a*, 312*b*, conduits 346*a*, 346*b*, 348*a*, 348 and check valves 316*a*, 316*b*, 318*a*, 318*b* may be facilitated by any suitable method, such as welding or by providing complementary threaded ends between adjoining components.

In operation, compressor 300 may operate in a similar manner to as previously described for compressor 200. Similar to as described above for compressor 200, check valves 316*a*, 316*b*, 318*a*, 318*b* are operable to move between open and closed configurations depending on the pressure differential across each check valve. When in a closed configuration, fluid is not permitted to flow in either direction through the check valve. When in an open configuration, fluid is permitted to flow in one direction only through the check valve. As shown in FIG. 2A, check valves 316*a*, 316*b*, 318*a*, 318*b* are all in a closed configuration and fluid may not enter or leave compression chamber 304.

Figure 5D:
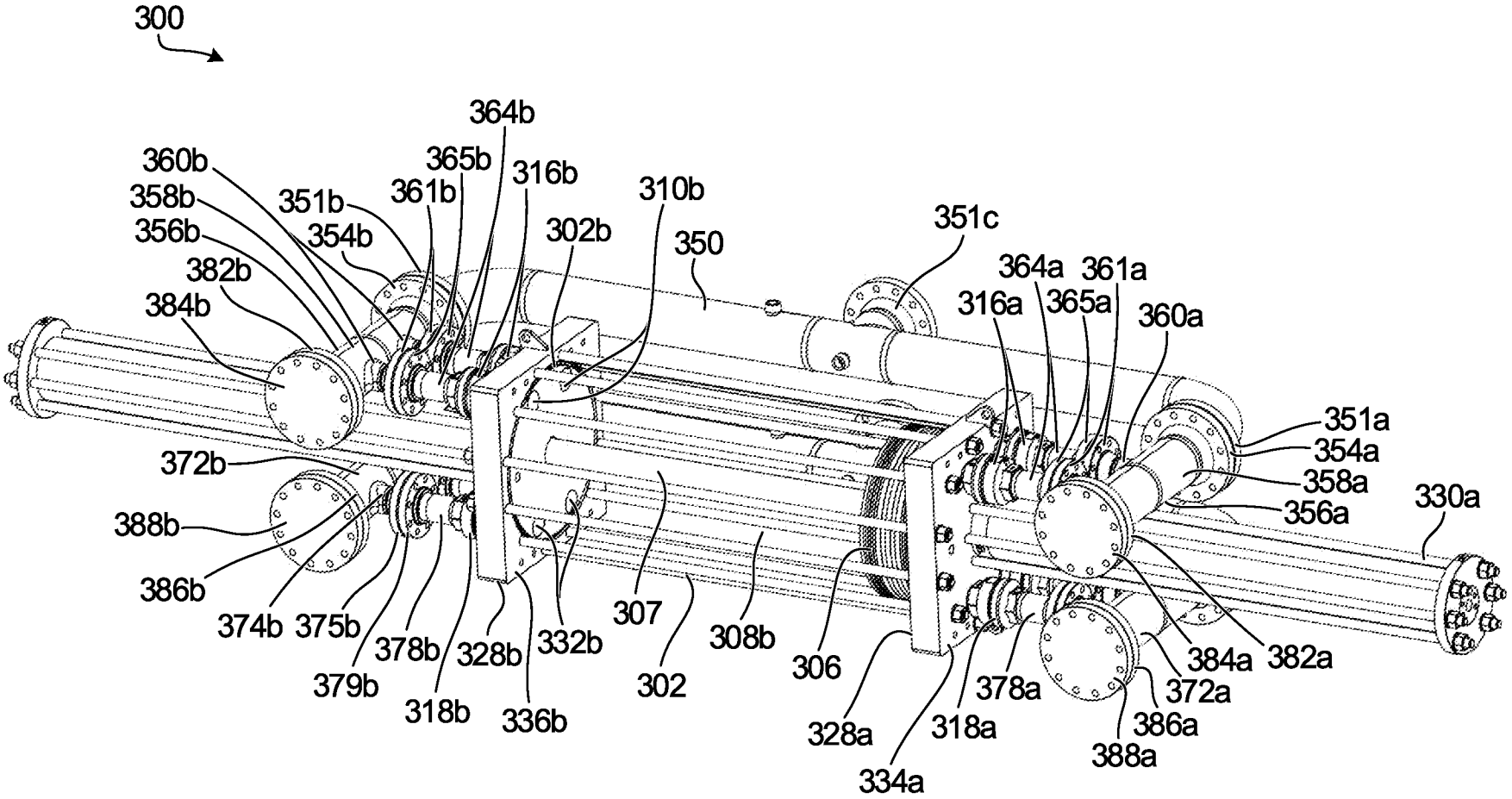
FIG. 5D is a partially transparent, rear perspective view of the compressor of FIG. 5A.
Figure 5E:
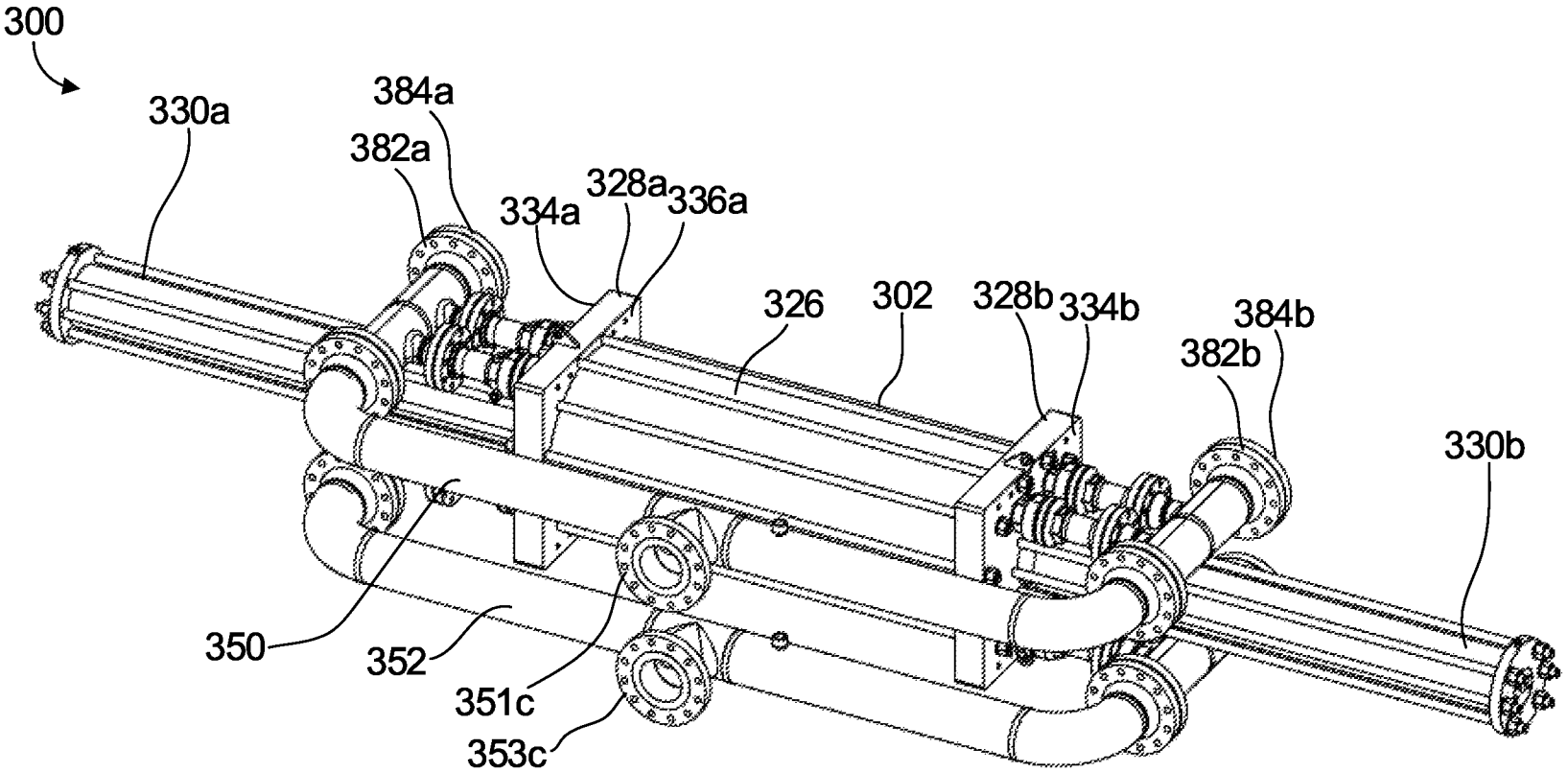
FIGS. 5E and 5F are front perspective and top plan views of the compressor of FIG. 5A.
Figure 5F:
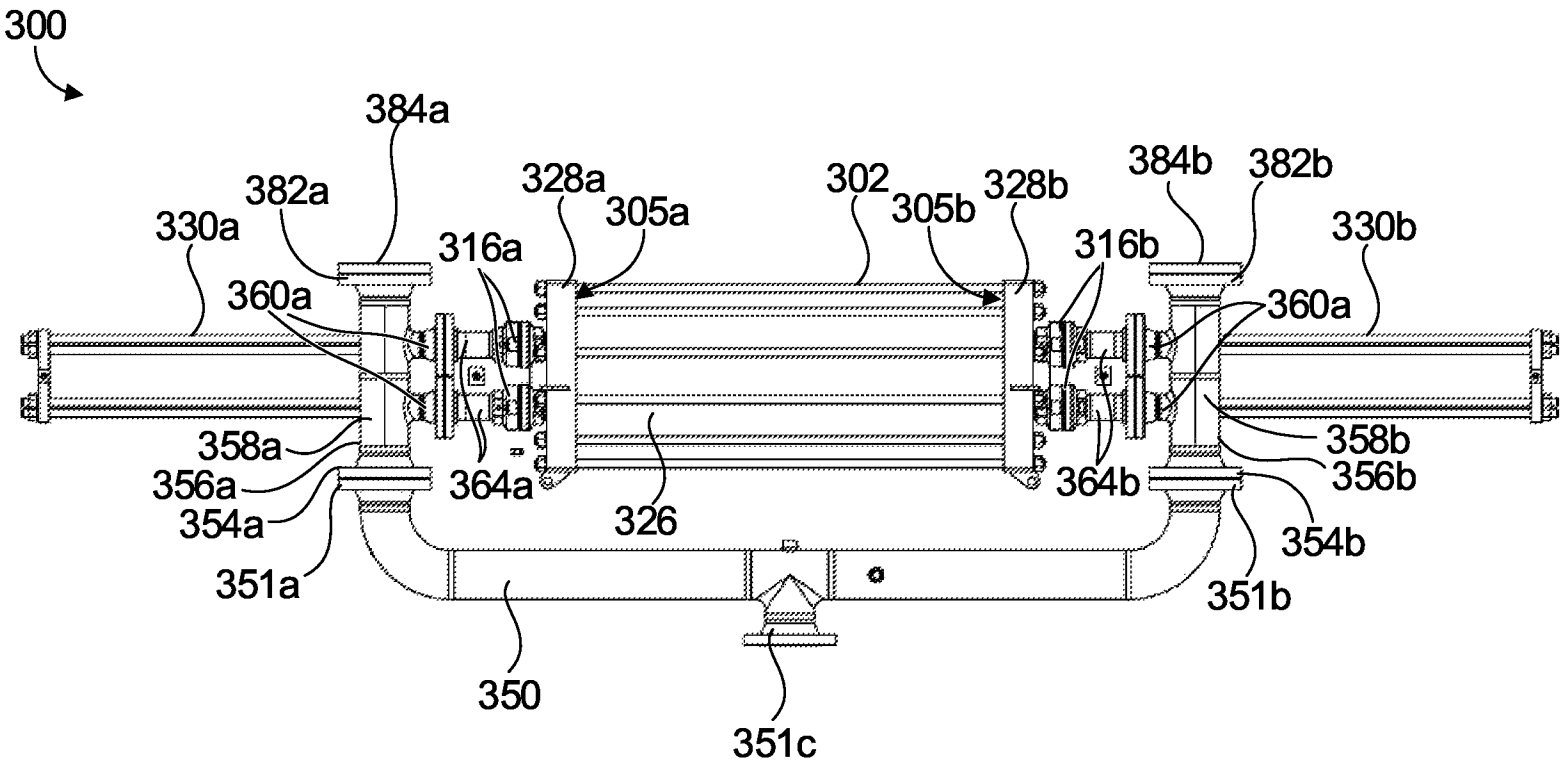
Figure 5G:
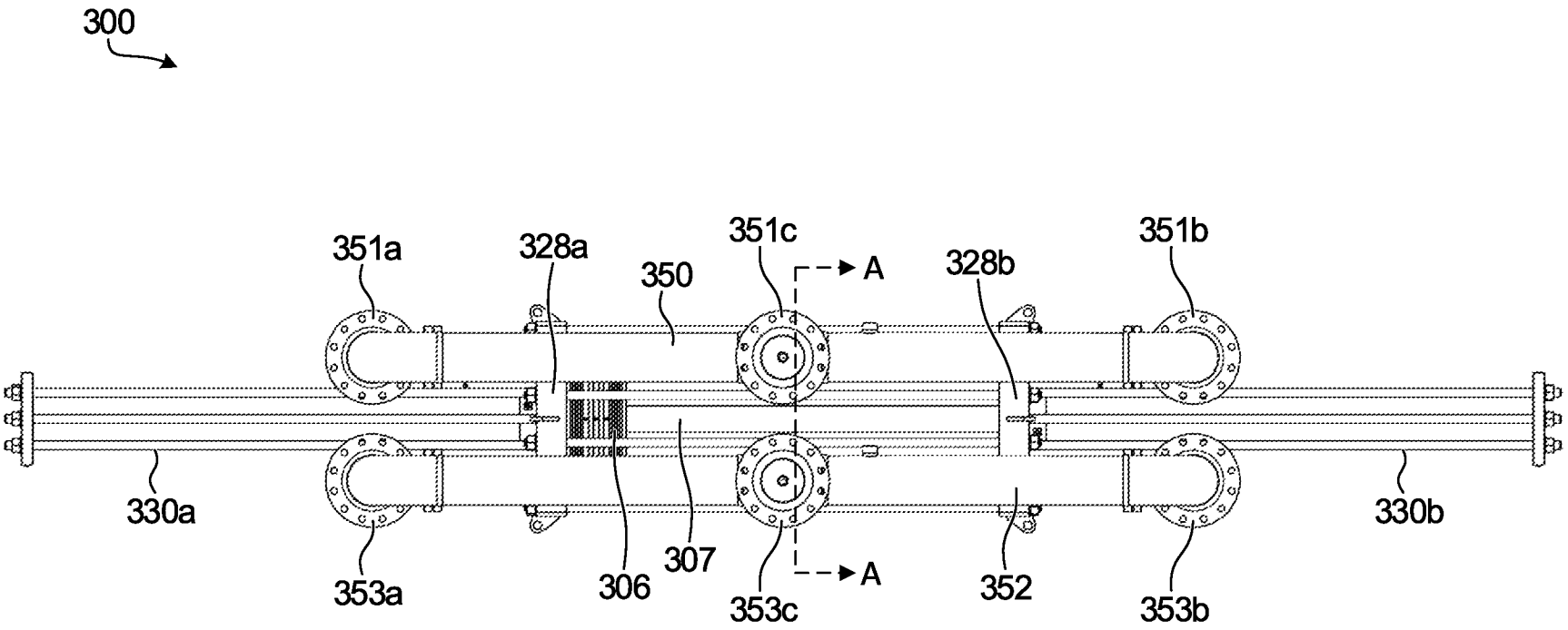
FIG. 5G is a partially transparent front view of the compressor of FIG. 5A.
Figure 5H:
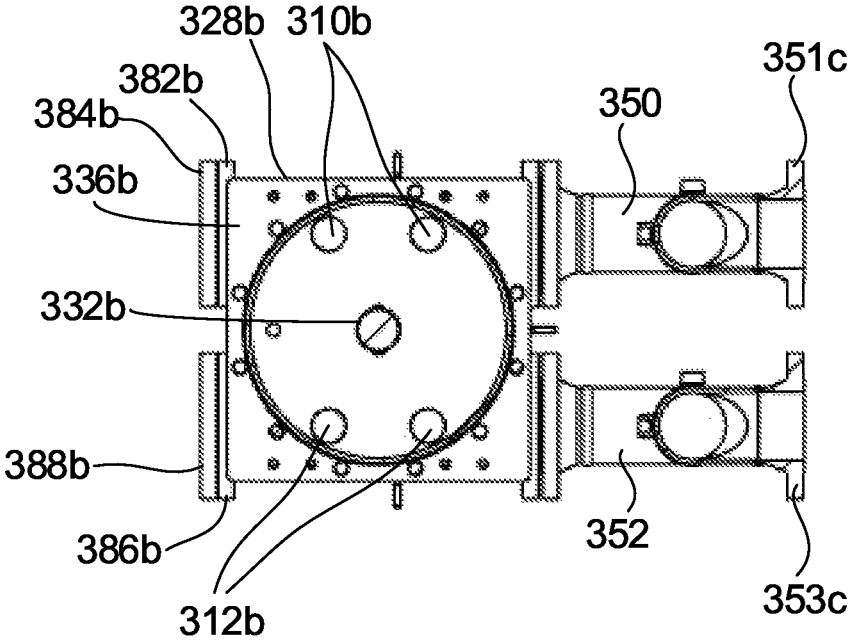
FIG. 5H is a cross sectional end view of the compressor of FIG. 5A, along the line A-A in FIG. 5G.
Figure 5I:
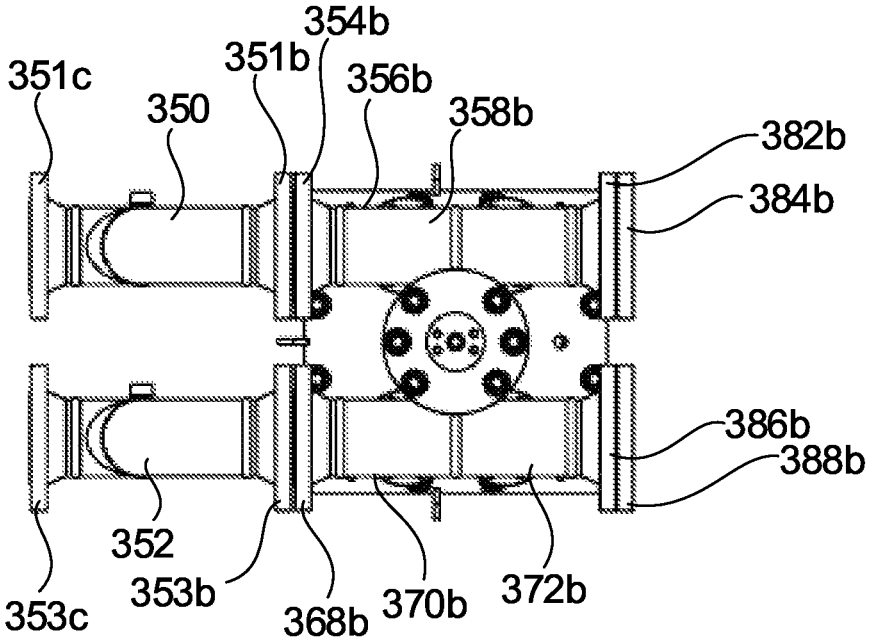
FIG. 5I is an end view of the compressor of FIG. 5A.
Figure 5J:
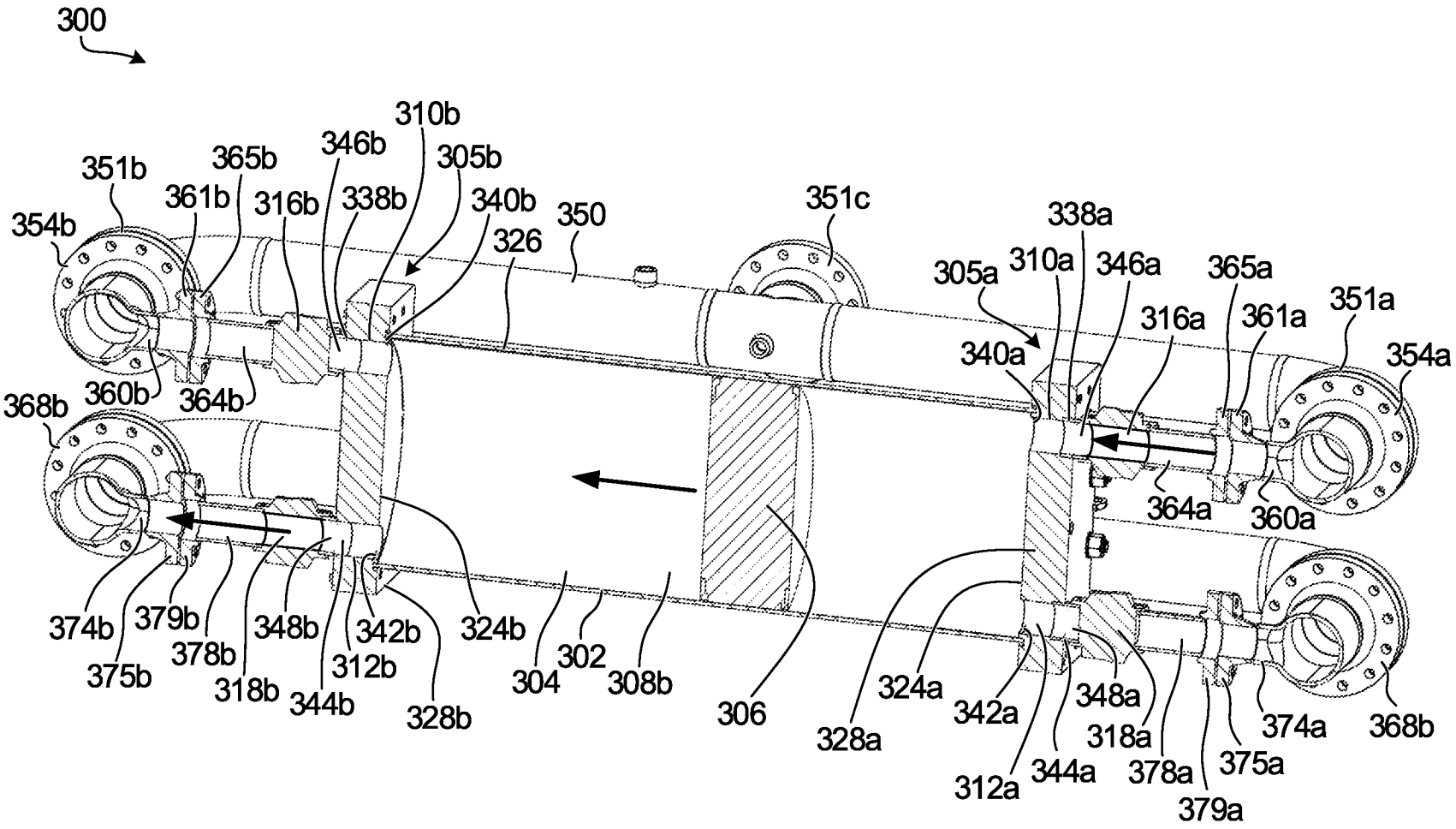
FIG. 5J is a cross-sectional rear perspective view of the compressor of FIG. 5A, with some check valves in an open configuration.

With reference to FIG. 5J, inlet check valve 316*a* and outlet check valve 318*b* are shown in the open configuration. This configuration is similar to as shown in FIG. 2C for compressor 200 and may occur when piston 306 is moving from first end of stroke position 324*a* to second end of stroke position 324*b* and the pressure differential across check valves 316*a*, 318*b* has reached the threshold pressure of the valves. With inlet check valves 316*a* in an open configuration, fluid can flow as indicated through secondary conduits 360*a*, inlet check valve connectors 364*a*, inlet check valves 316*a*, conduits 346*a* and into first compression chamber section 308*a* through first inlet ports 310*a*. With outlet check valves 318*b* in an open configuration, fluid can flow as indicated from second compression chamber section 308*b*, through second outlet ports 312*b*, conduits 348*b*, outlet check valves 318*b*, and into outlet check valve connectors 378*b*.

Figure 5K:
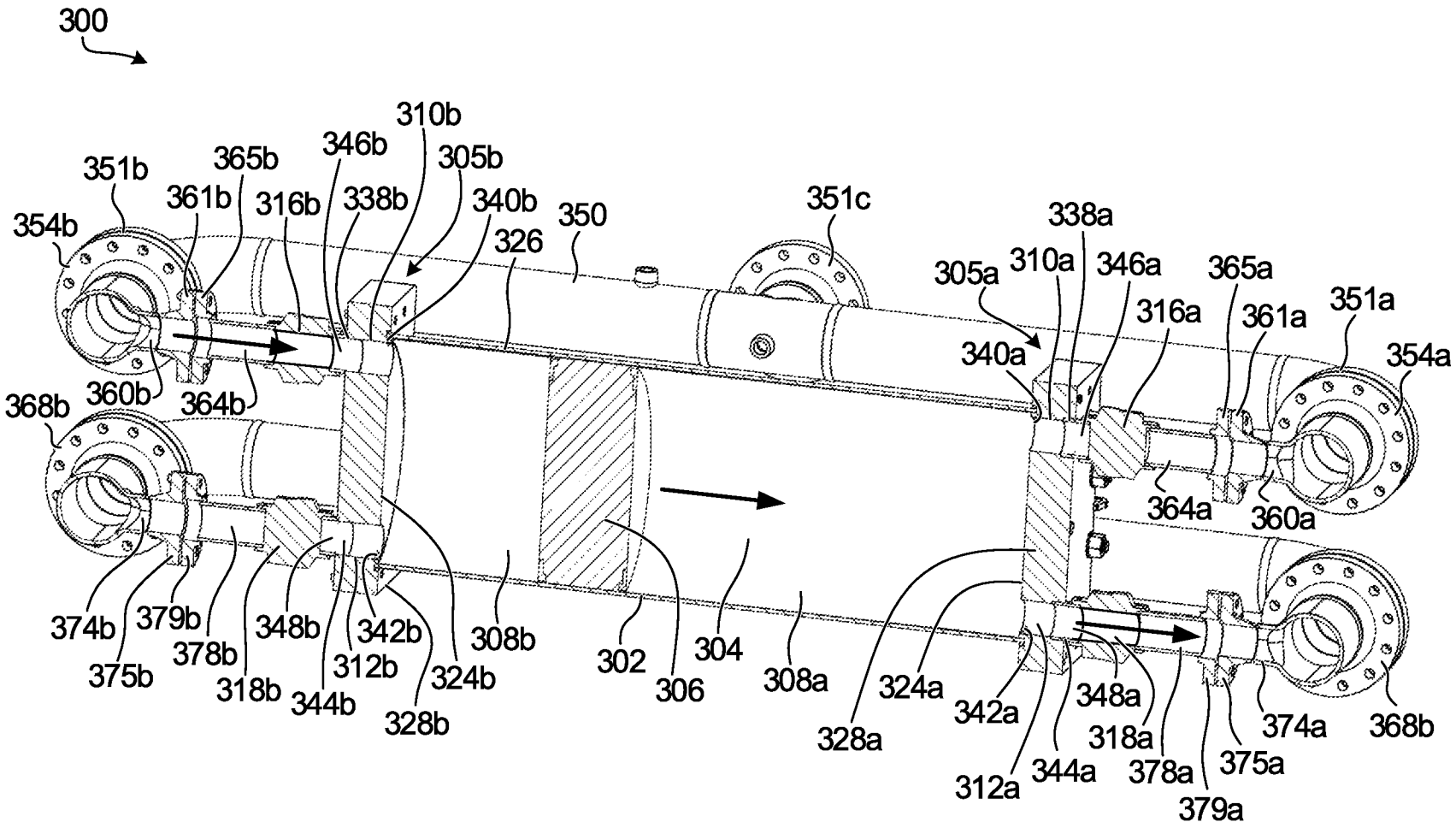
FIG. 5K is a cross-sectional rear perspective view of the compressor of FIG. 5A, with some check valves in an open configuration.

With reference to FIG. 5K, inlet check valve 316*b* and outlet check valve 318*a* are shown in the open configuration. This configuration is similar to as shown in FIG. 2E for compressor 200 and may occur when piston 306 is moving from second end of stroke position 324*b* to first end of stroke position 324*a* and the pressure differential across check valves 316*b*, 318*a* has reached the threshold pressure of the valves. With inlet check valves 316*b* in an open configuration, fluid can flow as indicated through secondary conduits 360*b*, inlet check valve connectors 364*b*, inlet check valves 316*b*, conduits 346*b* and into second compression chamber section 308*b* through first inlet ports 310*b*. With outlet check valves 318*a* in an open configuration, fluid can flow as indicated from first compression chamber section 308*a*, through first outlet ports 312*a*, conduits 348*a*, outlet check valves 318*a*, and into outlet check valve connectors 378*a*.

By providing multiple, smaller inlet and outlet ports on each of first and second head plates 328*a*, 328*b* (and corresponding smaller check valves and connectors) as opposed to single larger ports on each head plate, larger hydraulic cylinders may be used with compressor 300, which may be desirable in some applications such as when compressing a fluid with a high proportion of liquid.

With reference to FIGS. 5B-D in particular, the fluid communication system is shown, which provides fluid to compressor 300 to be compressed within compression chamber 304, may include suction intake manifold 350 and pressure discharge manifold 352.

On the fluid intake side of compressor 300, suction intake manifold 350 may have two manifold outlets 351*a* and 351*b* and a single manifold inlet 351*c*. A flange associated with outlet 351*a* is connected to first flange 354*a* of inlet connector 356*a*. Inlet connector 356*a* may include primary conduit 358*a*, which may have the same interior channel diameter as manifold 350, and a pair of smaller, spaced apart secondary conduits 360*a* extending orthogonally from primary conduit 358*a* (FIG. 5B). Flanges 361*a* associated with secondary conduits 360*a* are each connected to flanges 365*a* associated with inlet check valve connectors 364*a* which are in turn configured to connect to input check valves 316*a*. As such, inlet connector 356*a* and inlet check valve connectors 364*a* may provide fluid communication from outlet 351*a* of suction intake manifold 350 to inlet check valves 316*a*.

Similarly, a flange associated with outlet 351*b* is connected to first flange 354*b* of inlet connector 356*b*. Inlet connector 356*b* may include a primary conduit 358*b*, which may have the same interior channel diameter as manifold 350, and a pair of smaller, spaced apart secondary conduits 360*b* extending orthogonally from primary conduit 358*b* (FIGS. 5B, 5D). Flanges 361*b* associated with secondary conduits 360*b* are connected to flanges 365*b* associated with check valve connectors 364*b*, configured to connect to input check valves 316*b*. As such, inlet connector 356*b* and inlet check valve connectors 364*b* may provide fluid communication from outlet 351*b* of suction intake manifold 350 to inlet check valves 316*b*.

With reference to FIG. 5C, on the fluid pressure discharge side of compressor 300, pressure discharge manifold 352 may have two manifold inlets 353*a* and 353*b* and a single manifold outlet 353*c*. A flange associated with inlet 353*a* is connected to first flange 368*a* of outlet connector 370*a*. Outlet connector 370*a* may include primary conduit 372*a*, which may have the same interior channel diameter as manifold 352 and a pair of smaller, spaced apart secondary conduits 374*a* extending orthogonally from primary conduit 372*a*. Flanges 375*a* associated with secondary conduits 374*a* are connected to flanges 379*a* associated with outlet check valve connectors 378*a*, which are configured to connect to outlet check valves 318*a*. As such, outlet connector 370*a* and outlet check valve connectors 378*a* may provide fluid communication from outlet check valves 318*a* to manifold inlet 353*a* of pressure discharge manifold 352.

Similarly, a flange associated with inlet 353*b* is connected to a first flange 368*b* of outlet connector 370*b*. Outlet connector 370*a* may include a primary conduit 372*b*, which may have the same interior channel diameter as manifold 352 and a pair of smaller, spaced apart secondary conduits 374*b* extending orthogonally from primary conduit 372*b*. Flanges 375*b* associated with secondary conduits 374*b* are connected to flanges 379*b* associated with outlet check valve connectors 378*b*, which are configured to connect to outlet check valves 318*b*. As such, outlet connector 370*b* and outlet check valve connectors 378*b* may provide fluid communication from outlet check valves 318*b* to manifold inlet 353*b* of pressure discharge manifold 352.

Inlet connector 356*a* may also include second flange 382*a* at the opposite end of conduit 358*a* to first flange 354*a* and inlet connector 356*b* may also include second flange 382*b* at the opposite end of conduit 358*b* to first flange 354*b* (FIG. 5B). Blanking plates 384*a*, 384*b* may be secured to second flanges 382*a*, 382*b* respectively.

Outlet connector 370*a* may also include second flange 386*a* at the opposite end of conduit 372*a* to first flange 368*a* and outlet connector 370*b* may also include a second flange 386*b* at the opposite end of conduit 372*b* to first flange 368*b* (FIG. 5C). Blanking plates 388*a*, 388*b* may be secured to second flanges 386*a*, 388*b* respectively.

Second flanges 382*a*, 382*b*, 386*a*, 386*b*, may be operable to facilitate connections between multiple compressors, a representative example of which will be discussed later.

The manifolds, conduits and connectors described above may be sized dependent upon the required output/discharge pressures and output flow rates to be produced by compressor 300 and may be sized in order to achieve a desired maximum required flow velocity through compressor 300. In an embodiment the maximum flow velocity is 23 feet per second. For example, in some embodiments, suction intake manifold 350, pressure discharge manifold 352 and primary conduits 358*a*, 358*b*, 372*a*, 372*b* may all have approximately the same interior channel diameter, such as in the range of 4-6 inches or even greater. Secondary conduits 360*a*, 360*b*, 374*a*, 374*b*, check valve connectors 364*a*, 364*b*, 378*a*, 378*b* and conduits 346*a*, 346*b*, 348*a*, 346*b* may all have approximately the same interior channel diameter, such as in the range of 2-4 inches or even greater. Connections between the manifolds, check valves and conduits described above may be secured by any suitable method, such as by welding or by using threaded connections.

As shown in FIGS. 5A to 5I, compressor 300 is configured with inlet ports 310*a*, 310*b* at the top and outlet ports 312*a*, 312*b* at the bottom of cylinder heads 328*a*, 328*b*. This configuration may be beneficial, for example when compressor 300 is handling a fluid that contains a significant proportion of solids and/or debris which will migrate to the bottom of compression chamber 304 due to gravity and will be pumped out of chamber 304 during reciprocal movement of piston 306. This may increase the reliability of compressor 300 as the accumulation of solids and/or debris within compression chamber 304 is reduced.

However, the configuration of inlet and outlet ports may be selected according to the particular application of compressor 300 and may depend on a number of factors such as the desired inlet (suction) pressure, outlet pressure, gas and liquid volume fraction of the fluid and the proportion of solids and other debris in the fluid.

In other embodiments, the upper two ports on each of cylinder heads 328*a*, 328*b* may be outlet ports whilst the lower two ports may be inlet ports. This configuration may be beneficial, for example, when handling a fluid with a higher gas volume fraction and when a lower inlet pressure is desired.

Compressor 300 may be in hydraulic fluid communication with a hydraulic fluid supply system which may provide an open loop or closed loop hydraulic fluid supply circuit. The hydraulic fluid supply system may be configured to supply a driving fluid to drive the hydraulic pistons in hydraulic cylinders 330*a*, 330*b*.

Compressor 300 may also include a controller to control the operation of compressor 300, such as by changing the operational mode of the hydraulic fluid supply system. The control system may include a number of sensors such as proximity sensors in order to detect the position of components such as piston 306 within first cylinder 302 or pistons within hydraulic cylinders 330*a*, 330*b* in order to determine when piston 306 is approaching or has reached either of the end of stroke positions 324*a*, 324*b*. The controller may use information from the sensors to control the hydraulic fluid system in order to control and adjust the reversal of piston 306 in either direction. Examples of hydraulic cylinders, hydraulic fluid supply system and a control system suitable for use with compressor 300 are disclosed in U.S. Pat. No. 10,544,783, and US 20210270257, the entire contents of each of which are incorporated herein by reference.

Figure 6A:
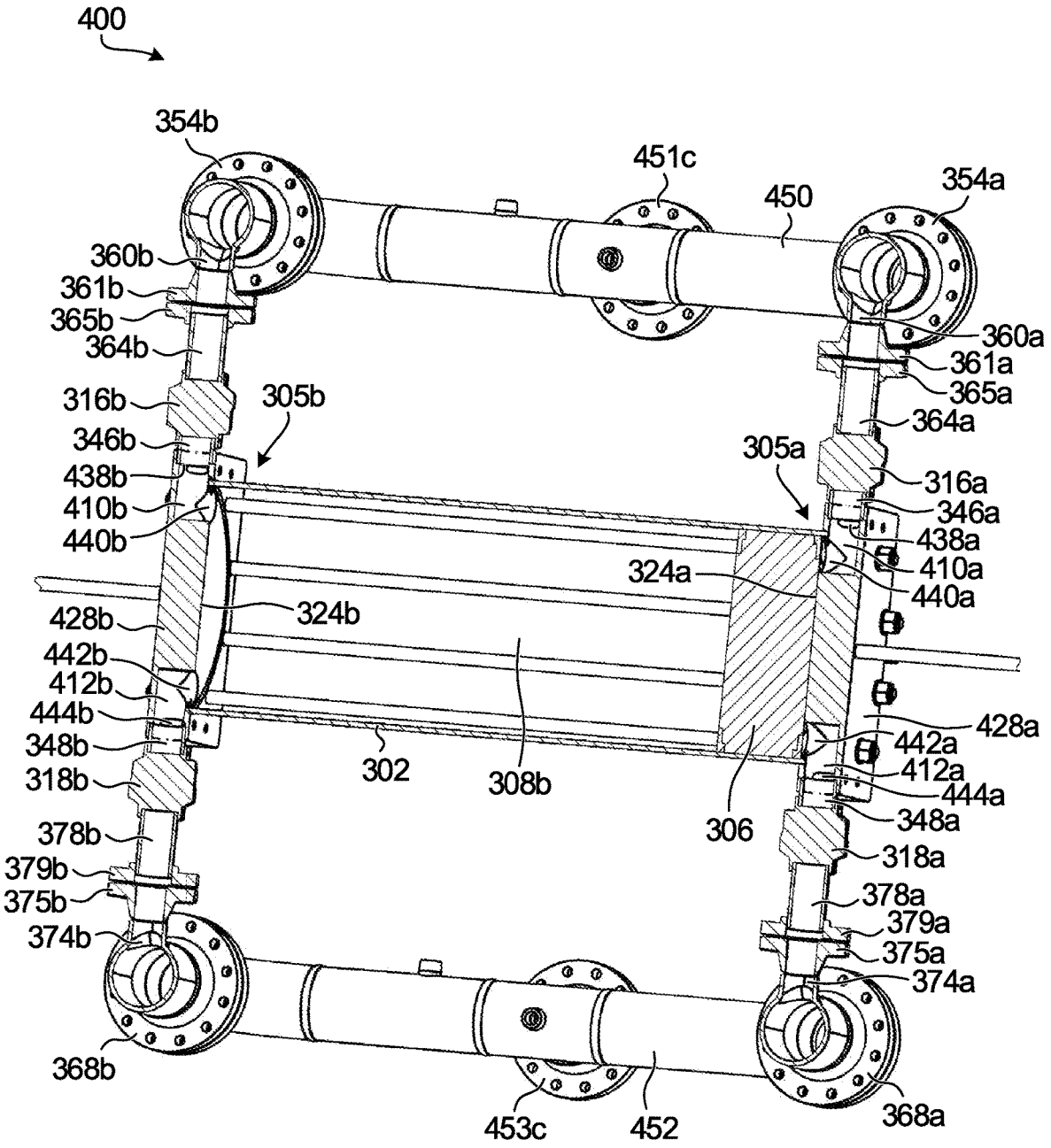
FIG. 6A is a partially transparent, cross-sectional rear perspective view of a compressor according to a further embodiment.
Figure 6B:
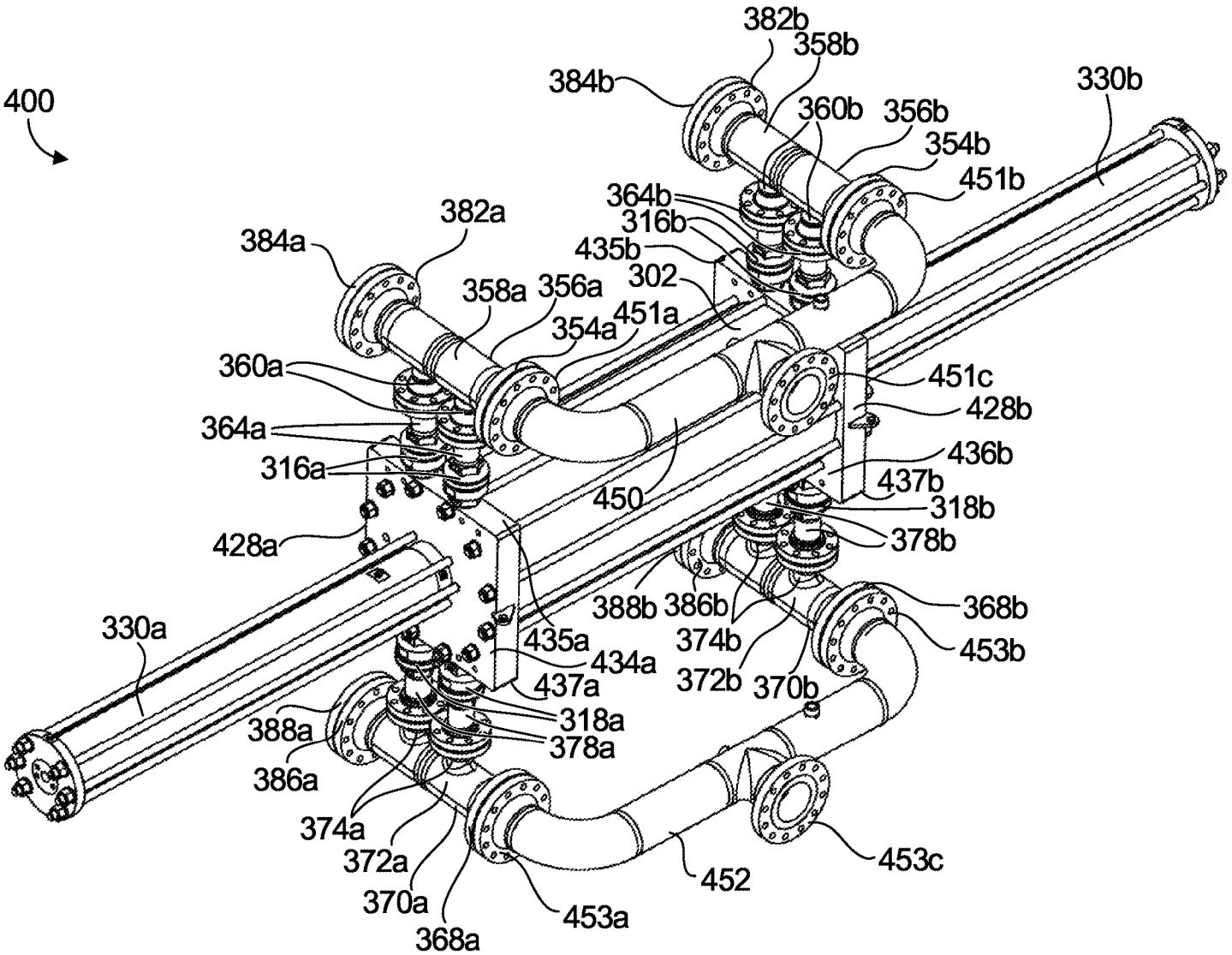
FIGS. 6B and 6C are front perspective views of the compressor of FIG. 6A.
Figure 6C:
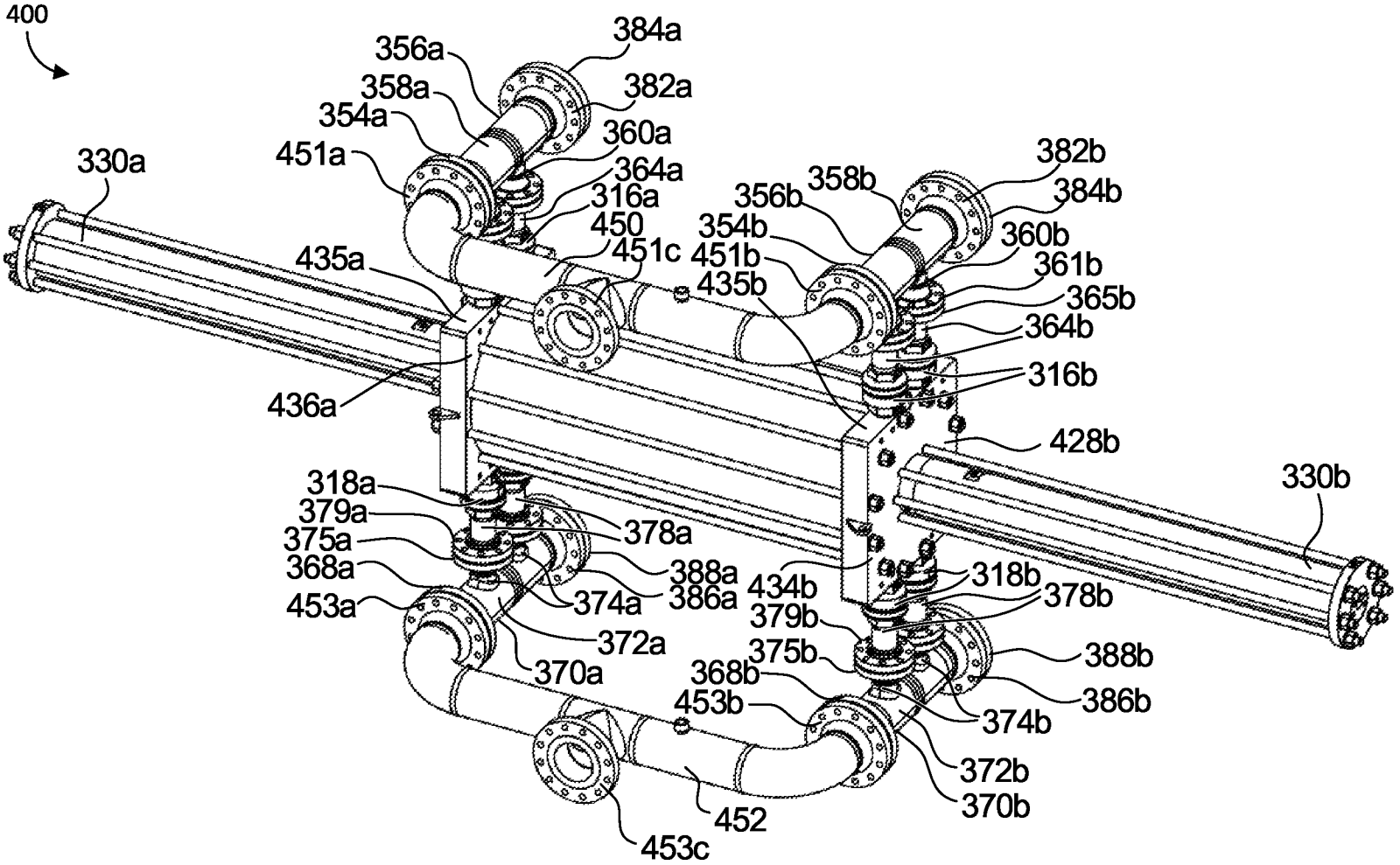
Figure 6D:
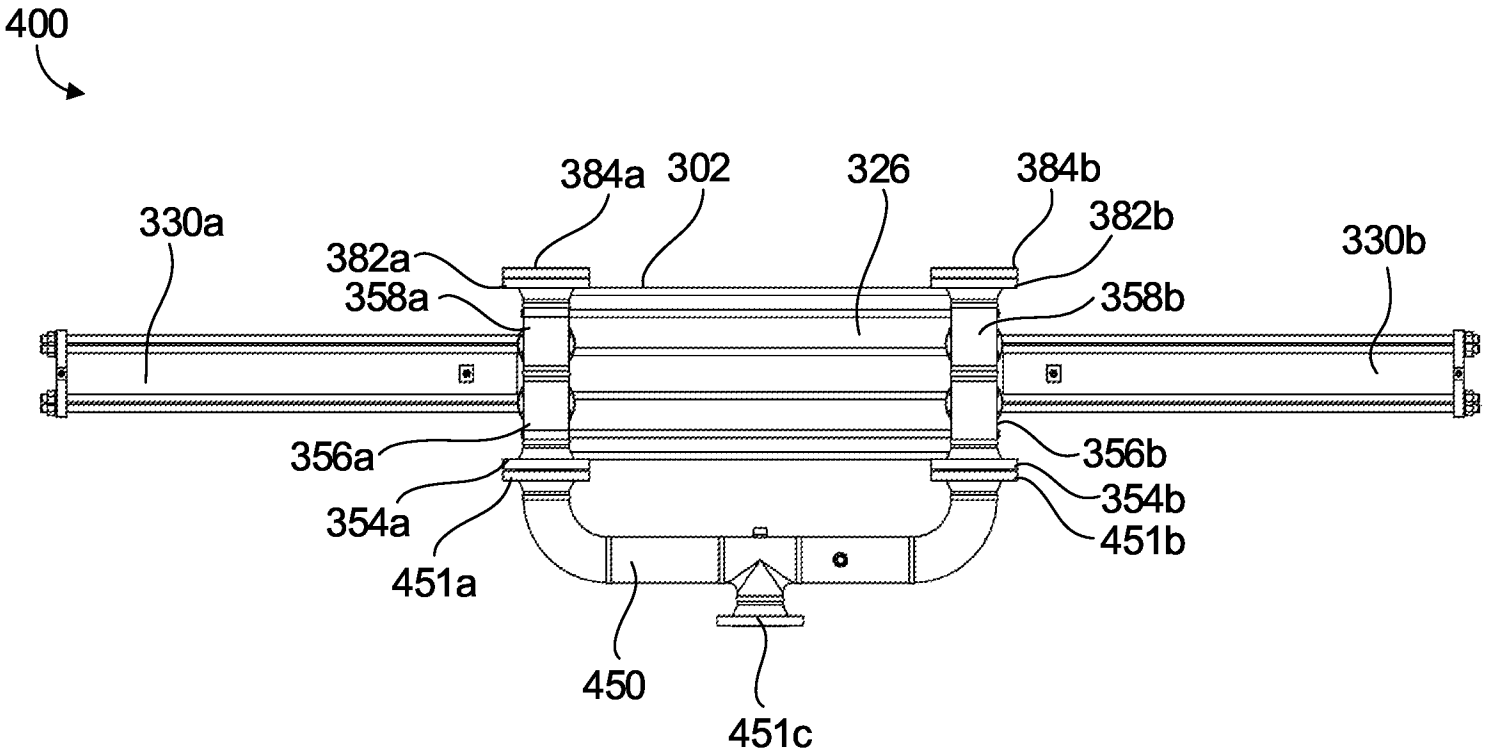
FIGS. 6D and 6E are top plan and front views of the compressor of FIG. 6A.
Figure 6E:
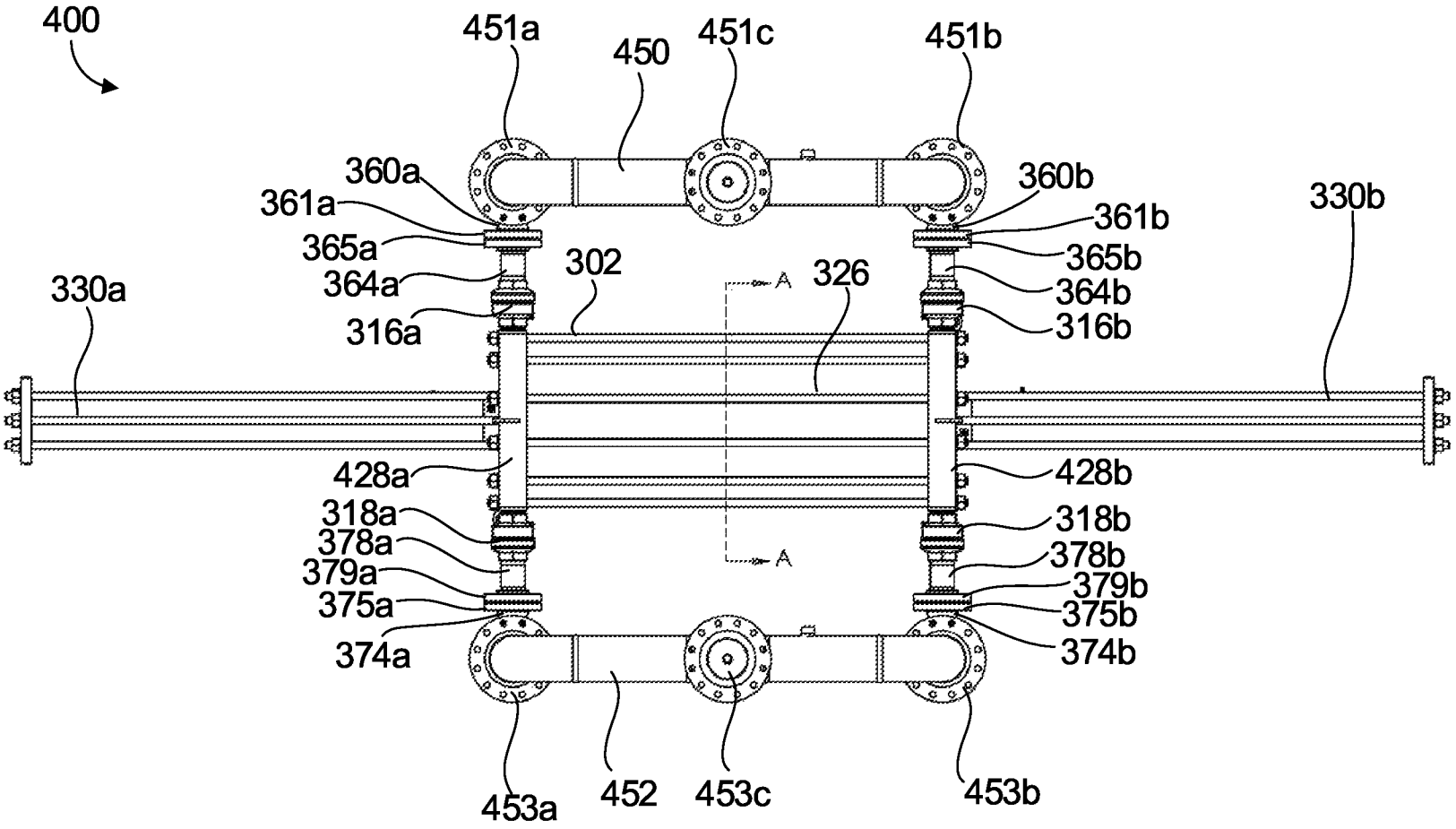
Figure 6G:
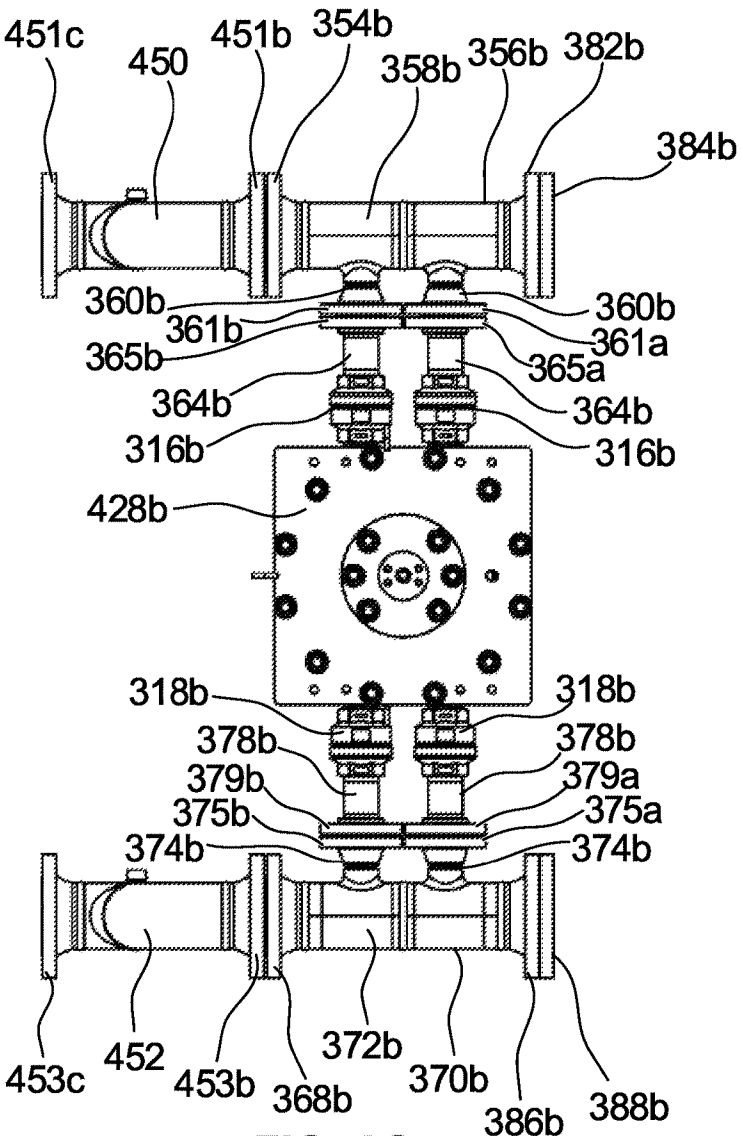
FIG. 6G is an end view of the compressor of FIG. 6A.

Turning to FIGS. 6A to 6G, another embodiment of a compressor 400 is shown, which is an example embodiment of the compressor 200' shown in FIG. 4. First cylinder 302 of compressor 400 may include cylinder barrel/tubular wall 326 positioned between first and second cylinder head plates 428*a*, 428*b* at respective first and second ends 305*a*, 305*b* of compression chamber 304. First head plate 428*a* may have a generally square or rectangular shape with a pair of upper first inlet ports 410*a*, a pair of lower first outlet ports 412*a* and a centrally located piston rod opening 432*a* (not shown). As shown in FIG. 6A, first inlet ports 410*a* may extend within first head plate 428*a* in a downwards direction from first ends 438*a* in top face 435*a* before turning at 90 degrees inwards to second ends 440*a* in inner face 436*a* of first head plate 428*a*. First outlet ports 412*a* may extend in an outwards direction from first ends 442*a* in inner face 436*a* of first head plate 428*a* before turning at 90 degrees downwards to second ends 444*a* in bottom face 437*a* of first head plate 428*a*.

Figure 6F:
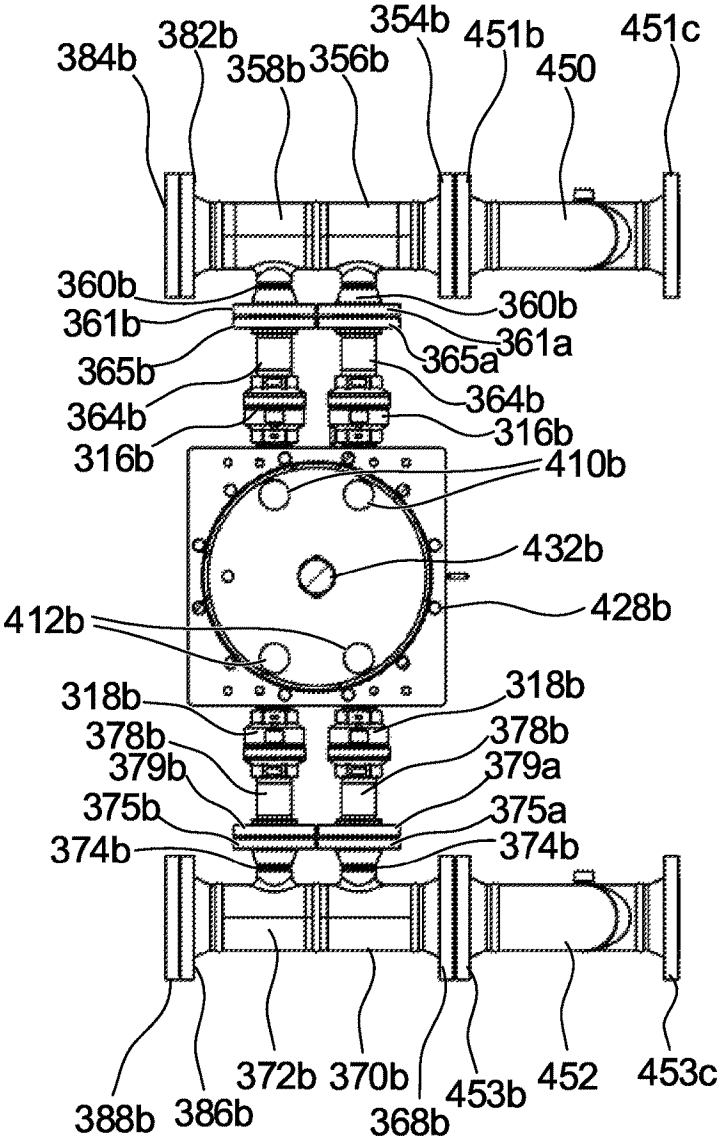
FIG. 6F is a cross sectional end view of the compressor of FIG. 6A, along the line A-A in FIG. 6E.

Similarly, second head plate 428*b* may have a generally square or rectangular shape with a pair of upper second inlet ports 410*b*, a pair of lower second outlet ports 412*b* and a centrally located piston rod opening 432*b* (FIG. 6F). Second inlet ports 410*b* may extend within second head plate 428*b* in a downwards direction from first ends 438*b* in top face 435*b* before turning at 90 degrees inwards to second ends 440*b* in inner face 436*a* of second head plate 428*a*. Second outlet ports 412*a* may extend in an outwards direction from first ends 442*b* in inner face 436*a* of second head plate 428*b* before turning at 90 degrees downwards to second ends 444*b* in bottom face 437*b* of second head plate 428*b*.

Connected to each of the first ends 438*a*, 438*b* of inlet ports 410*a*, 410*b* may be respective inlet check valves 316*a*, 316*b* configured to ensure that fluid may flow into compression chamber 304 from inlet ports 410*a*, 410*b* (i.e., fluid only travels in the direction from first ends 438*a*, 438*b* to second ends 440*a*, 440*b* of inlet ports 410*a*, 410*b*). In some embodiments, inlet check valves 316*a*, 316*b* may be connected directly to first ends 438*a*, 438*b* of inlet ports 410*a*, 410*b*. In the embodiment shown in FIG. 6A, short conduits 346*a*, sized to be partially received within first ends 438*a* of inlet ports 410*a*, may be disposed between inlet check valves 316*a* and first inlet ports 410*a*. Similarly, short conduits 346*b*, sized to be partially received within first ends 438*b* of inlet ports 410*b*, may be disposed between inlet check valves 316*b* and second inlet ports 410*b*.

Similarly, connected to each of the second ends 444*a*, 444*b* of outlet ports 412*a*, 412*b* may be respective outlet check valves 318*a*, 318*b* configured to ensure that fluid may flow into outlet ports 412*a*, 412*b*, from compression chamber 304 (i.e., fluid only travels in the direction from first ends 442*a*, 442*b* to second ends 444*a*, 444*b* of outlet ports 412*a*, 412*b*). In some embodiments, outlet check valves 318*a*, 318*b* may be connected directly to second ends 444*a*, 444*b* of outlet ports 412*a*, 412*b*. In the embodiment shown in FIG. 6A, short conduits 348*a*, sized to be partially received within second ends 444*a* of outlet ports 412*a*, may be disposed between outlet check valves 318*a* and first outlet ports 412*a*. Similarly, short conduits 348*b*, sized to be partially received within second ends 444*b* of outlet ports 412*b*, may be disposed between outlet check valves 318*b* and second outlet ports 412*b*.

Configuring compressor 400 such that the inlet and outlet ports are on the upper and lower faces of cylinder heads 428*a*, 428*b* provides additional space on the outer faces 434*a*, 434*b* of cylinder heads 428*a*, 428*b*. This may provide space for accommodating larger diameter hydraulic cylinders on compressor 400 as desired.

In other embodiments of compressor 400, the upper ports on each of cylinder heads 428*a*, 428*b* may be outlet ports whilst the lower ports may be inlet ports.

Referring to FIGS. 6B to 6E, the fluid communication system that provides fluid to compressor 400 may be generally similar to the fluid communication system of compressor 300, but is sized to connect to the differently positioned check valves 316*a*, 316*b*, 318*a*, 318*b* on compressor 400. The fluid communication system may include suction intake manifold 450 and pressure discharge manifold 452. Suction intake manifold 450 may have two manifold outlets 451*a* and 451*b* and a single manifold inlet 451*c*. A flange associated with outlet 451*a* is connected to a first flange 354*a* of inlet connector 356*a*, which is in turn connected to first inlet check valves 316*a* through inlet check valve connectors 364*a*. A flange associated with outlet 451*b* is connected to a first flange of inlet connector 356*b* which is in turn connected to second inlet check valves 316*b* through check valve connectors 364*b*.

On the fluid pressure discharge side of compressor 400, pressure discharge manifold 452 may have two manifold inlets 453*a* and 453*b* and a single manifold outlet 453*c*. A flange associated with inlet 453*a* is connected to first flange 368*a* of outlet connector 370*a* which is in turn connected to first outlet check valves 318*a* through outlet check valve connectors 378*a*. A flange associated with inlet 453*b* is connected to a first flange 368*b* of outlet connector 370*b* which is in turn connected to second outlet check valves 318*a* through outlet check valve connectors 378*b*.

Providing first and second inlet and first and second outlet ports through each of first and second head plates 428*a*, 428*b* as opposed to a larger single inlet and single outlet port in each head plate may be desirable in order to reduce the thickness of head plates 428*a*, 428*b*. For example, the pair of first inlet ports 410*a* may each have a diameter of around 2 inches. In order to achieve a similar flow velocity of fluid, a single inlet port to replace ports 410*a* would be required to have a larger diameter, for example about 4 inches. This would undesirably significantly increase the thickness of head plate 428*a* in order to accommodate the larger port within, increasing the size, weight and cost (through the extra material required for the thicker cylinder head) of the compressor.

Turning to FIGS. 7A to 7G, another embodiment of a compressor 500 is shown, which is another example embodiment of compressor 200 shown in FIG. 2A.

Figure 7A:
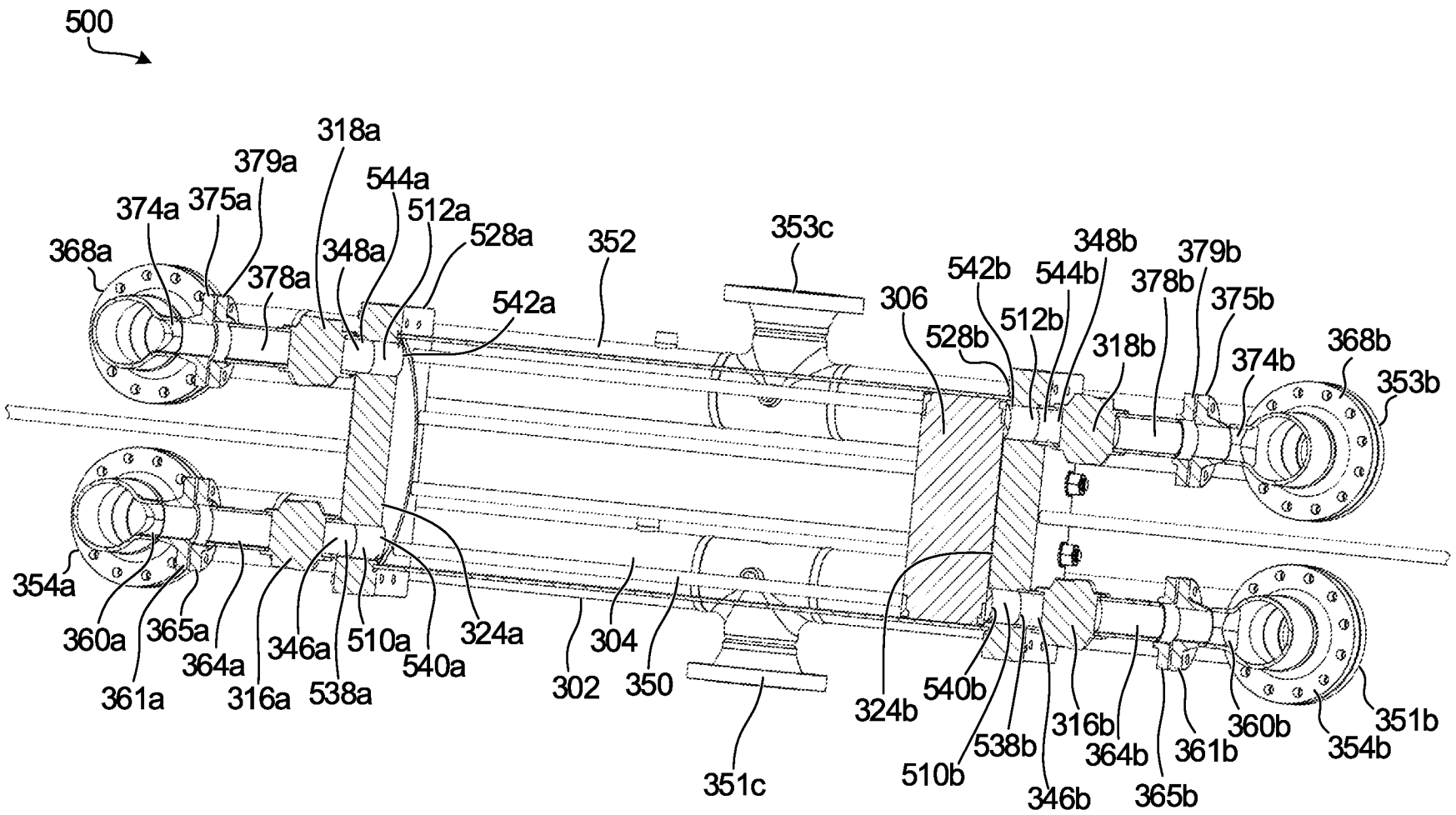
FIG. 7A is a partially transparent, cross-sectional top perspective view of a compressor according to a further embodiment.
Figure 7B:
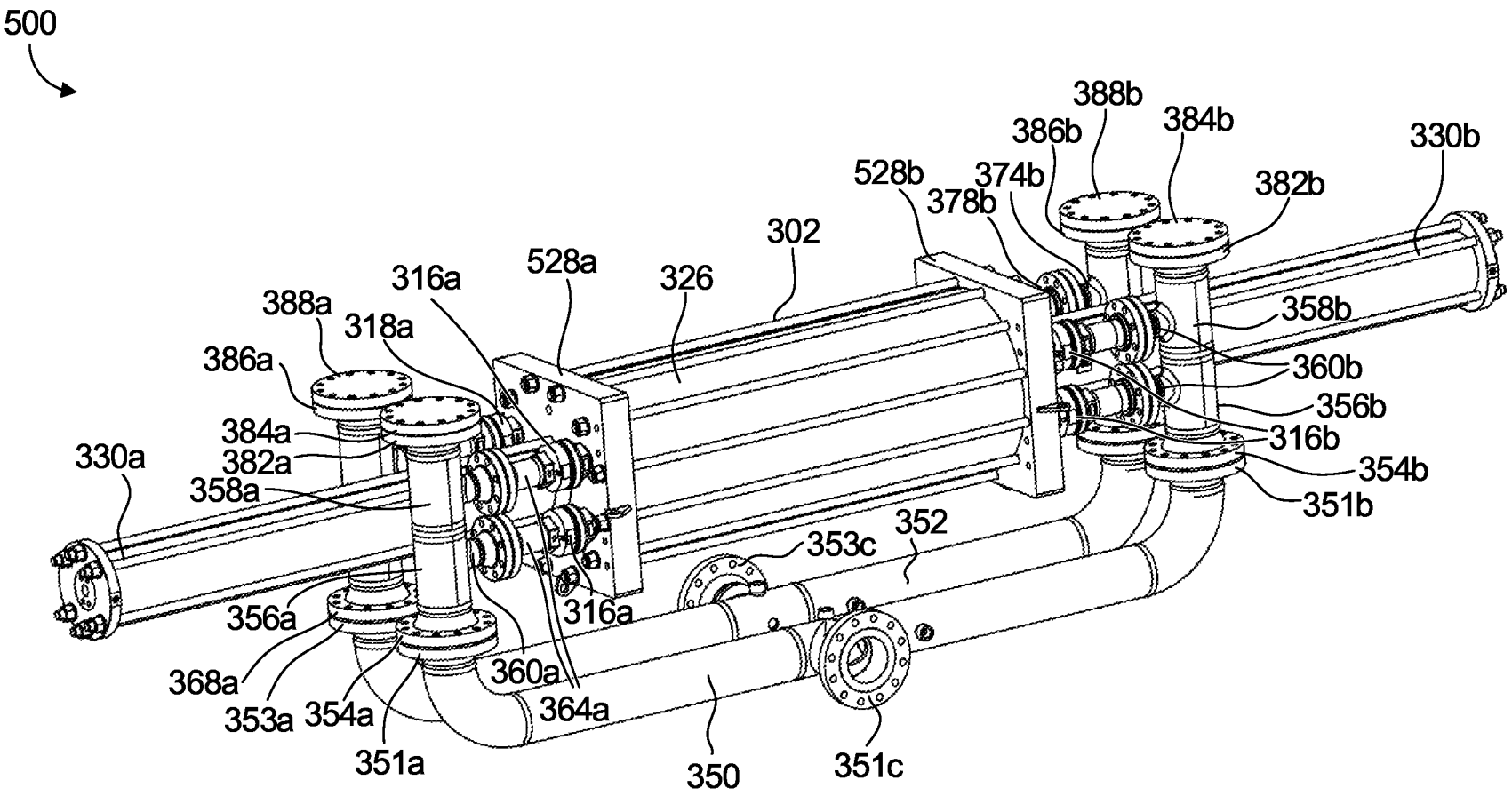
FIGS. 7B and 7C are front perspective views of the compressor of FIG. 7A.
Figure 7C:
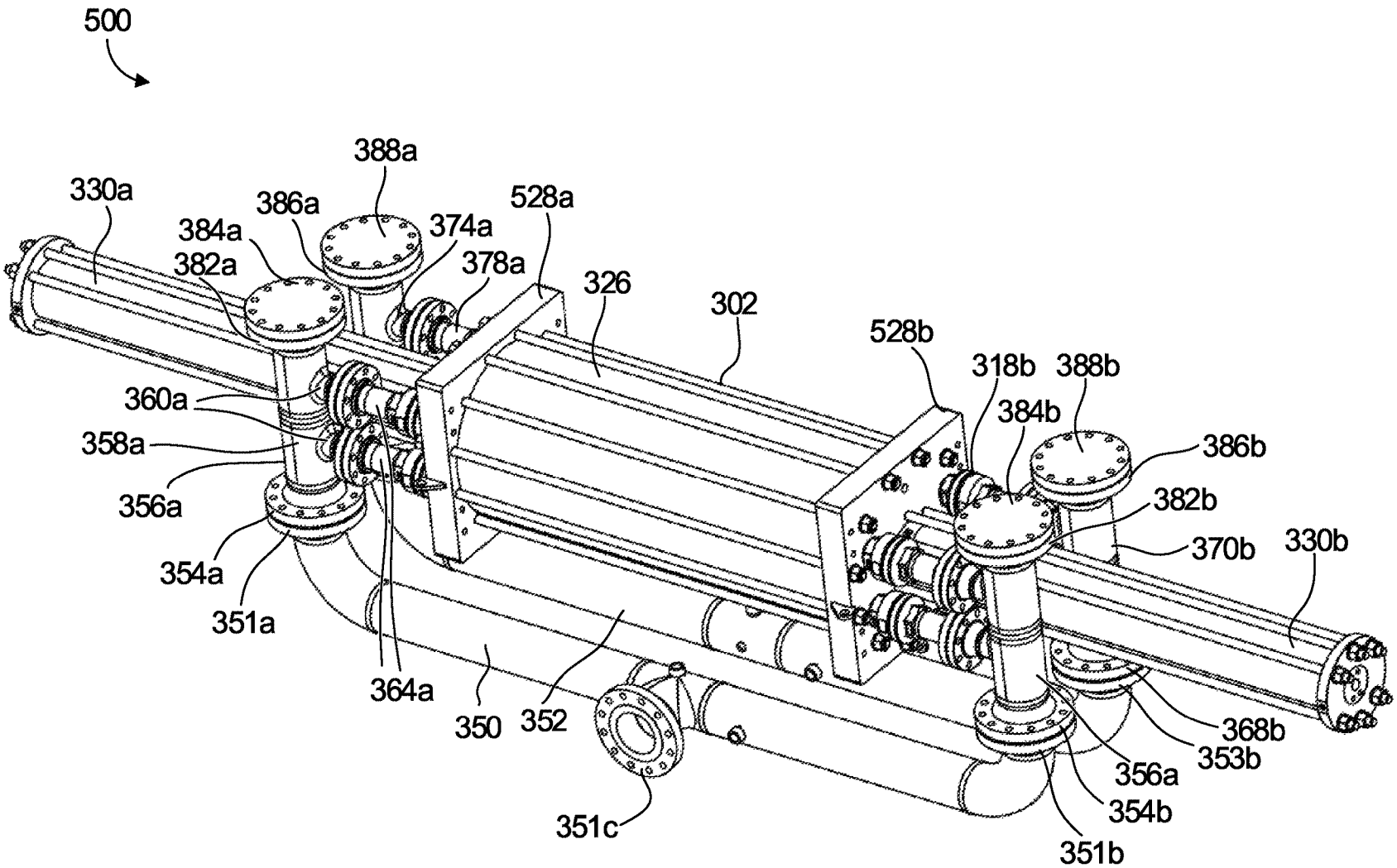
Figure 7D:
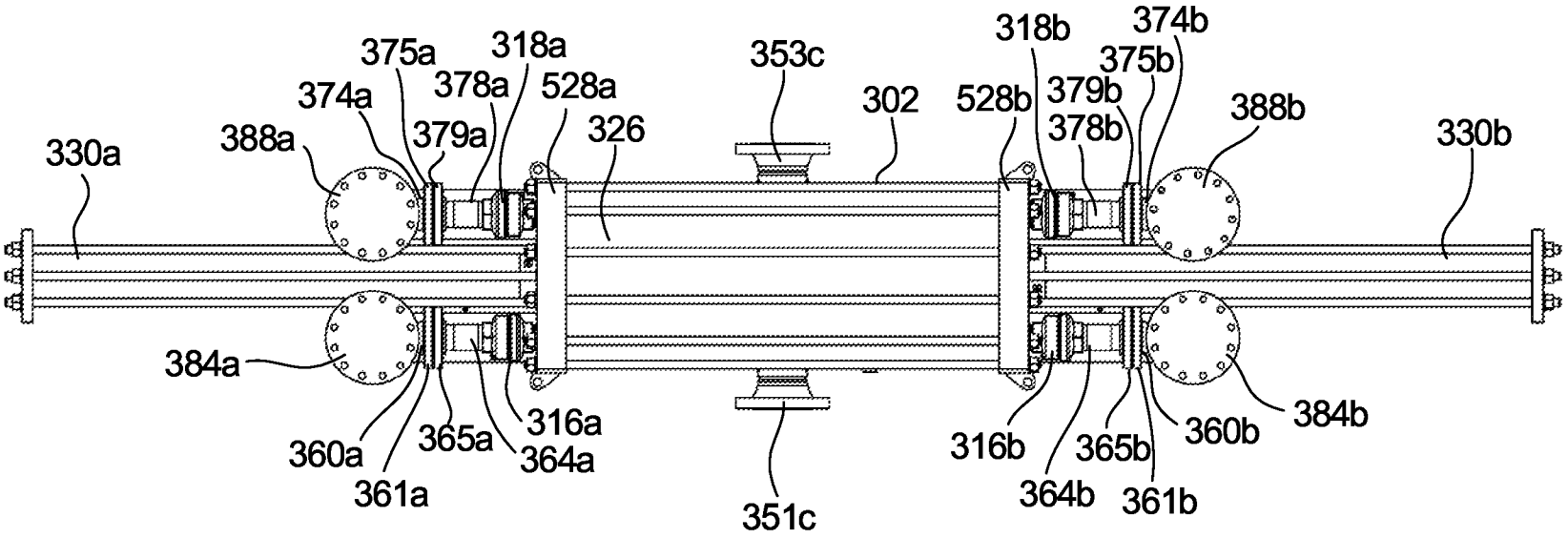
FIGS. 7D and 7E are top plan and front views of the compressor of FIG. 7A.
Figure 7E:
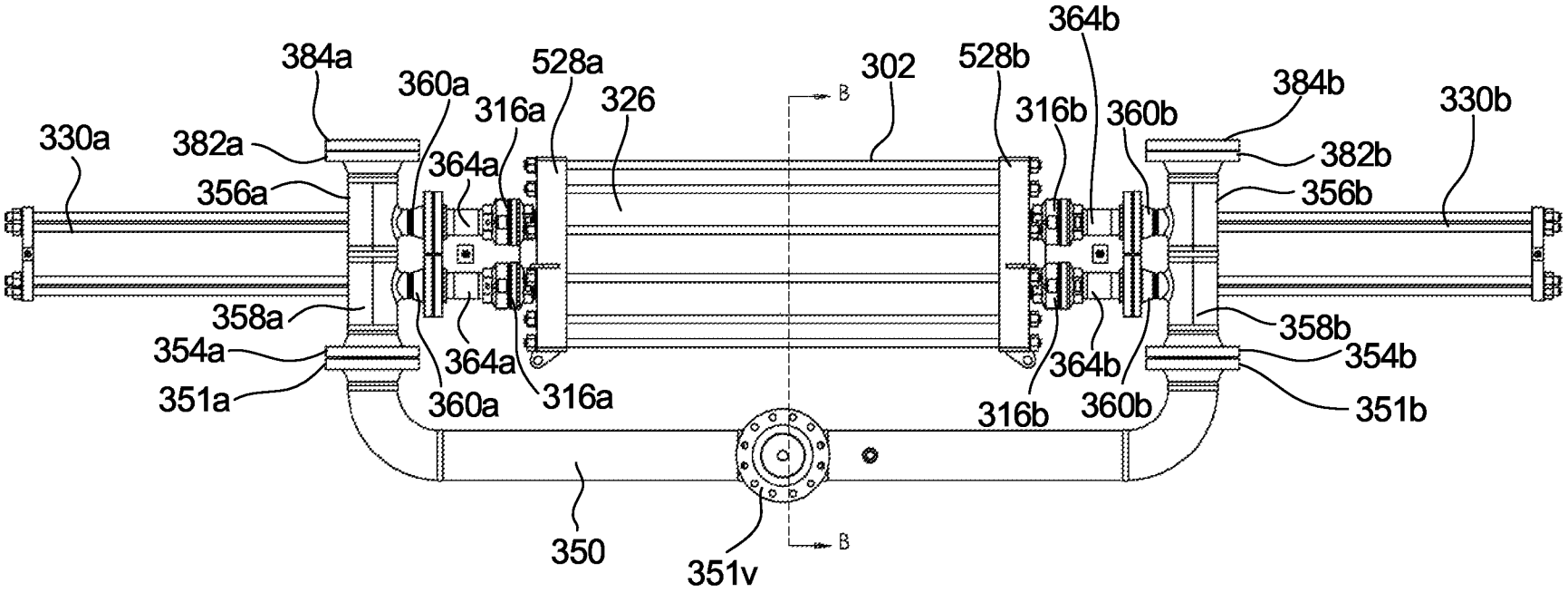
Figure 7G:
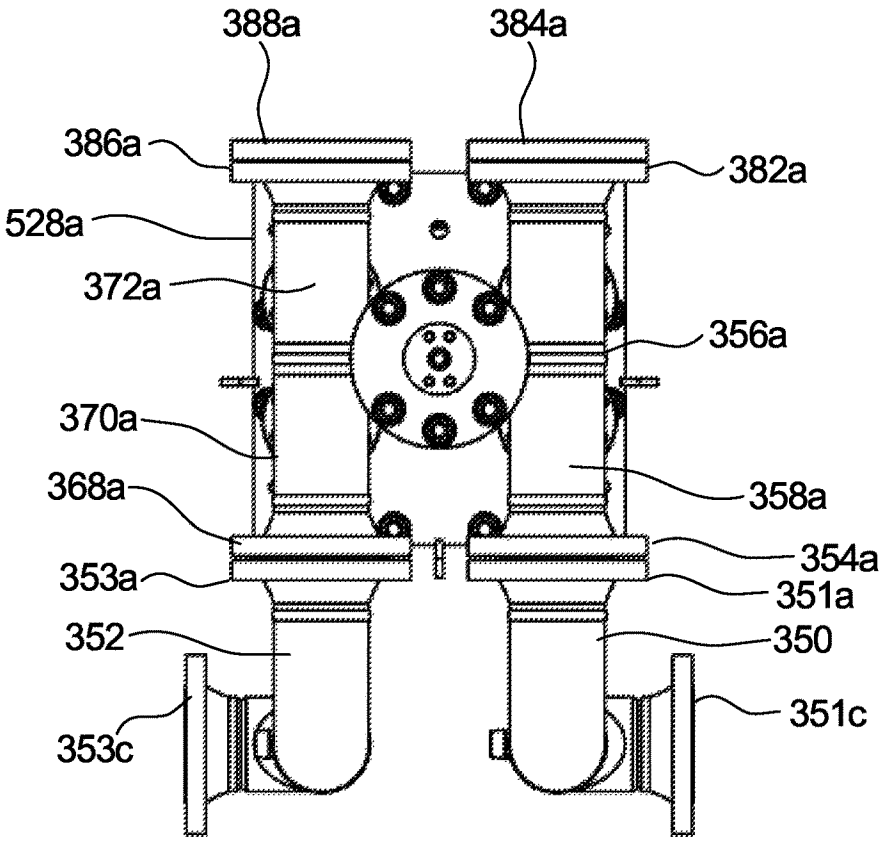
FIG. 7G is an end view of the compressor of FIG. 7A.
Figure 7F:
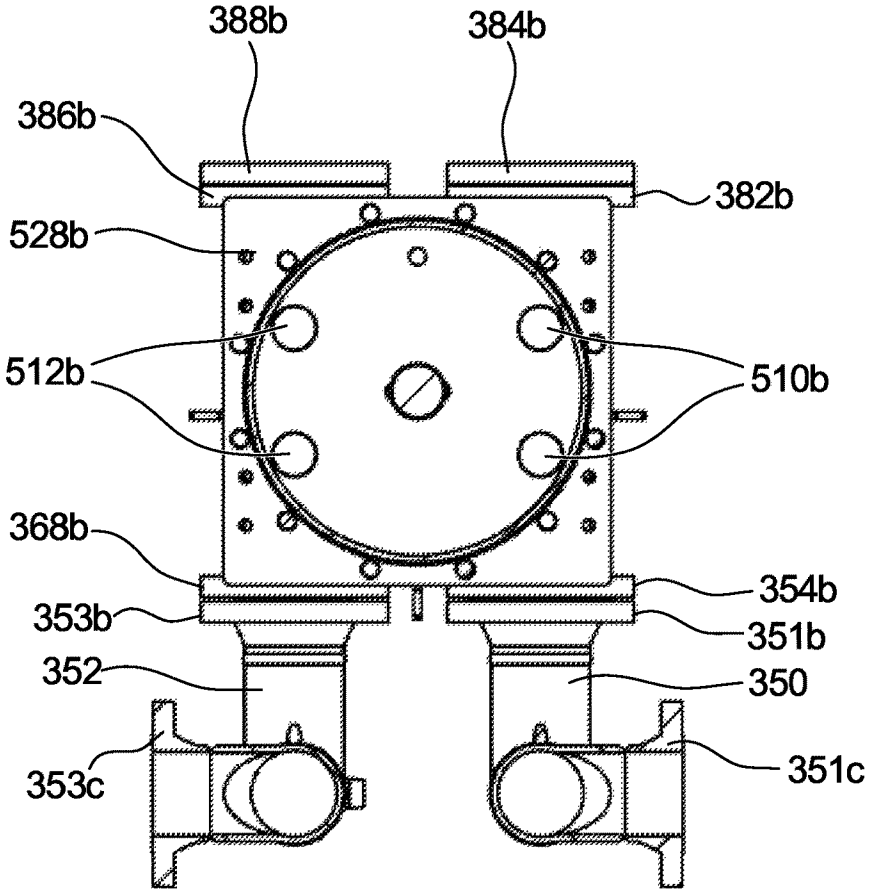
FIG. 7F is a cross sectional end view of the compressor of FIG. 7A, along the line B-B in FIG. 7E.

In comparison to compressor 300 described above, first head plate 528*a*, whilst generally similar to first head plate 328*a*, may be configured with a pair of first inlet ports 510*a* vertically spaced from each other on a first side of first head plate 528*a*. Similar to first inlet ports 310*a*, first inlet ports 510*a* may extend through first head plate 528*a* and are configured to receive fluid at an outer, first end 538*a* and communicate fluid to an inner, second end 540*a* inside first chamber section 308*a* (FIG. 7A). First head plate 528*a* may also be configured with a pair of first outlet ports 512*a*, vertically spaced from each other on the opposite side of first head plate 528*a* to first inlet ports 510*a*. Similar to first outlet ports 312*b*, first outlet ports 512*b* may extend through first head plate 528*a* and are configured to receive fluid at an inner, first end 542*a* inside first chamber section 308*a* and communicate fluid to an outer, second end 544*a*.

Second head plate 528*b* may be generally similar to first head plate 328*b* and may be configured with a pair of second inlet ports 510*b* vertically spaced from each other on a first side of second head plate 528*b*. Similar to second inlet ports 310*b*, second inlet ports 510*b* may extend through second head plate 528*b* and are configured to receive fluid at an outer, first end 538*b* and communicate fluid to an inner, second end 540*b* inside second chamber section 308*b* (FIG. 7A). Second head plate 528*b* may also be configured with a pair of first outlet ports 512*b*, vertically spaced from each other on the opposite side of second head plate 528*b* to first inlet ports 510*a*. Similar to second outlet ports 312*b*, second outlet ports 512*b* may extend through second head plate 528*b* and are configured to receive fluid at an inner, first end 542*b* inside second chamber section 308*b* and communicate fluid to an outer, second end 544*b*.

First and second inlet ports 510*a*, 510*b* may be connected to suction intake manifold 350 in a similar manner to as described above for compressor 300 through inlet connectors 356*a*, 356*b*, inlet check valve connectors 364*a*, 364*b* and inlet check valves 316*a*, 316*b* for supplying fluid to compression chamber 304, with inlet connectors 356*a*, 356*b* and intake manifold 350 oriented to accommodate the different inlet port configuration of compressor 500.

First and second outlet ports 512*a*, 512*b* may be connected to pressure discharge manifold 352 in a similar manner to as described above for compressor 300 through outlet check valves 318*a*, 318*b*, outlet check valve connectors 378*a*, 378*b* and outlet connectors 370*a*, 370*b* for receiving fluid from compression chamber 304, with outlet connectors 370*a*, 370*b* and pressure discharge manifold 352 oriented to accommodate the different outlet port configuration of compressor 500.

Figure 8:
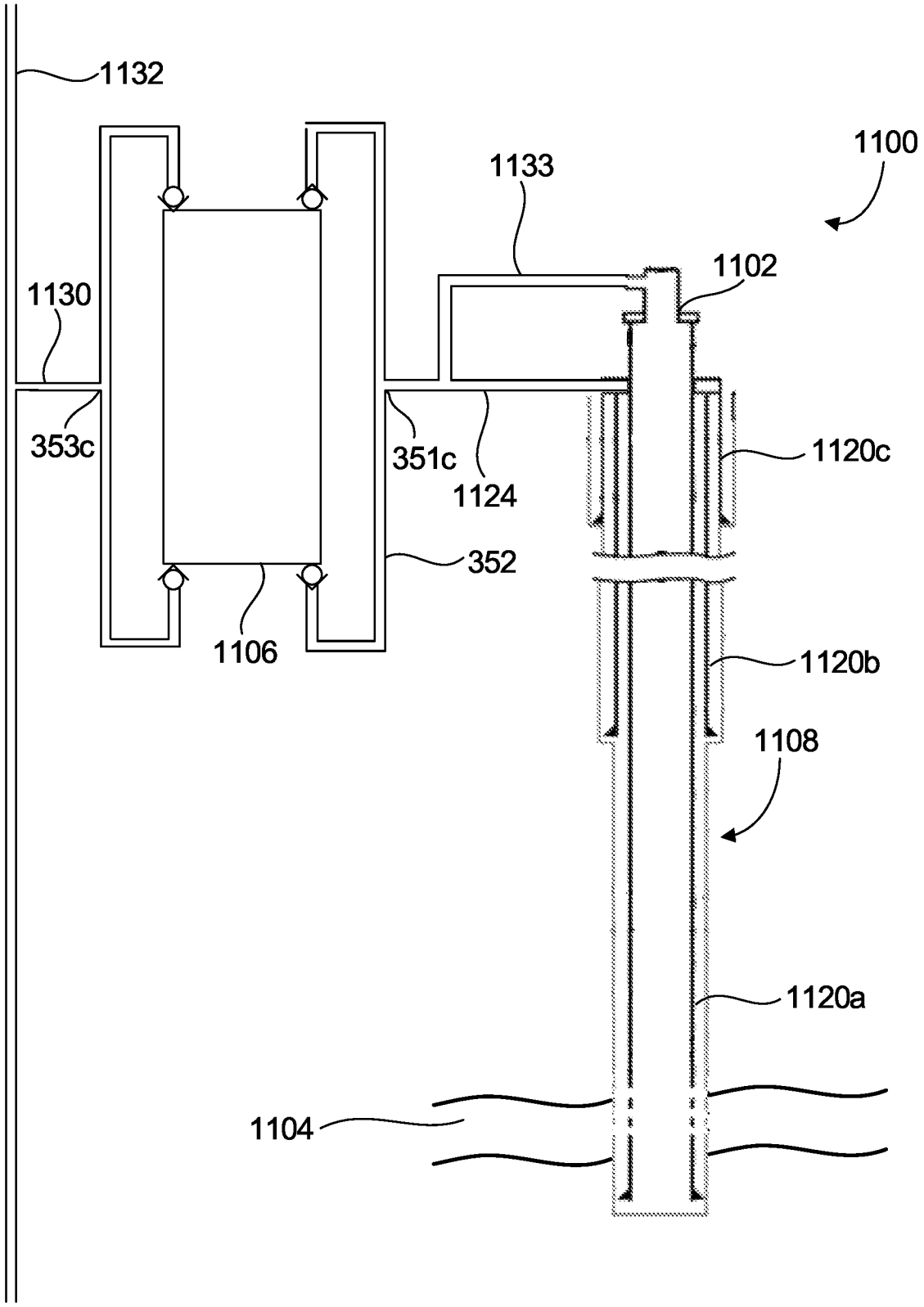
FIG. 8 is a schematic view of an oil and gas producing well system.

With reference to FIG. 8 an example oil and gas producing well system 1100 is illustrated, which utilises a compressor 1106, which may be any compressors described above. Oil and gas producing well system 1100 is illustrated schematically and may be installed at, and in, a well shaft (also referred to as a well bore) 1108 and may be used for extracting liquid and/or gases (e.g., oil and/or natural gas) from an oil and gas bearing reservoir 1104.

Extraction of liquids including oil as well as other liquids such as water from reservoir 1104 may be achieved by methods such as the use of a down-well pump, which operates to bring a volume of oil toward the surface to a well head 1102. An example of a suitable down-well pump is disclosed in U.S. patent application Ser. No. 16/147,188, filed Sep. 28, 2018 (now U.S. patent Ser. No. 10,544,783, issued Jan. 28, 2020), the entire contents of which is hereby incorporated herein by reference.

Well shaft 1108 may have along its length, one or more generally hollow cylindrical tubular, concentrically positioned, well casings 1120*a*, 1120*b*, 1120*c*, including an inner-most production casing 1120*a* that may extend for substantially the entire length of the well shaft 1108. Intermediate casing 1120*b* may extend concentrically outside of production casing 1120*a* for a substantial length of the well shaft 1108, but not to the same depth as production casing 1120*a*. Surface casing 1120*c* may extend concentrically around both production casing 1120*a* and intermediate casing 1120*b*, but may only extend from proximate the surface of the ground level, down a relatively short distance of the well shaft 1108.

Natural gas may exit well shaft 1108 into piping 1124 whilst liquid may exit well shaft 1108 through a well head 1102 to an oil flow line 1133. Oil flow line 1133 may carry the liquid to piping 1124, which in turn carries the combined gas and oil to inlet manifold 351*c* of compressor 1106. Compressor 1106 may operate substantially as described above to compress gas and liquid supplied by piping 1124. Compressed fluid that has been compressed by compressor 1106 may exit though outlet manifold 353*c* and flow via piping 1130 to interconnect to pipeline 1132.

In another embodiment, a plurality of compressors may be connected in series in order to provide a pressure boost to a fluid. An advantage to this approach is that less energy is required to compress fluid, such as gas, in multiple stages.

In an example embodiment, a first compressor may be connected to a second compressor such that fluid flows through the first compressor to the second compressor. Fluid at a first pressure P1 may have its pressure boosted to a second pressure P2 (that is greater than P1) by the first compressor. Fluid may then flow to the second compressor, where the pressure of the fluid will be boosted to a third pressure P3 (that is greater than P2).

The first and second compressors may be interconnected in a number of suitable configurations in order for fluid that has been compressed in compression chamber sections 308*a*, 308*b* of the first compressor to flow to the second compressor. For example, when the first and second compressors are both similar to compressor 300, second flanges 386*a*, 386*b* (with blanking plates 388*a*, 388*b* removed) on the first compressor may be interconnected to manifold inlet 351*c* or second flanges 382*a*, 382*b* of the second compressor.

In one embodiment, the first and second compressors may have different specifications. For example, the second compressor may be configured to handle fluid at a higher pressure and have hydraulic cylinders and a piston with a larger diameter than the first compressor.

For example, in an embodiment, the first compressor may have an inlet pressure of 50 psi and an outlet pressure of 250 psi and the second compressor may have an inlet pressure of 250 psi and an outlet pressure of 500 psi.

The compressors may also be employed in other oilfield and other non-oilfield environments to transfer gas and multi-phase fluids efficiently and quietly.

Whilst the illustrated embodiments depict compressors with two inlet ports and two outlet ports on each cylinder head, other variations are contemplated with different numbers of inlet and/or outlet ports on each cylinder head.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Of course, the above described embodiments are intended to be illustrative only and in no way limiting. The described embodiments of carrying out the invention are susceptible to many modifications of form, arrangement of parts, details, and order of operation. The invention, therefore, is intended to encompass all such modifications within its scope.

What is claimed is:

1. A compressor comprising:

a first cylinder for compressing a fluid, comprising a chamber configured to receive the fluid and having a first end and a second end, a piston reciprocally movable in the chamber for alternately compressing the fluid towards the first end or the second end, first ports at the first end of the chamber, the first ports comprising a centrally located first opening, at least one first inlet port at an upper portion of the first end, and at least two first outlet ports at a lower portion of the first end, and second ports at the second end of the chamber, the second ports comprising a centrally located second opening, at least one second inlet port at an upper portion of the second end, and at least two second outlet ports at a lower portion of the second end, wherein each one of the first and second inlet and outlet ports defines a fluid flow path extending along an axial direction of the respective port;

at least one second cylinder each connected and configured to drive movement of the piston in the first cylinder through one of the first and second openings;

a plurality of inlet check valves including a first inlet check valve associated with the at least one first inlet port and connected inline with the at least one first inlet port along the axial direction of the at least one first inlet port, and a second inlet check valve associated with the at least one second inlet port and connected inline with the at least one second inlet port along the axial direction of the at least one second inlet port;

a first plurality of outlet check valves each associated with a respective one of the at least two first outlet ports and each connected inline to the respective one of the at least two first outlet ports via a respective first connection conduit along the axial direction of the associated one of the at least two first outlet ports, and second plurality of outlet check valves each associated with a respective one of the at least two second outlet ports and each connected inline to the respective one of the at least two second outlet ports via a respective second connection conduit along the axial direction of the associated one of the at least two second outlet ports;

an inlet conduit connected to each one of the plurality of inlet check valves for connecting a fluid source to the at least one first inlet port and the at least one second inlet port to supply the fluid from the fluid source to the chamber through the at least one first inlet port and the at least one second inlet port; and an outlet conduit connected to each one of the first outlet check valves and the second outlet check valves for receiving the fluid from the chamber through the at least two first outlet ports and the at least two second outlet ports, wherein the piston is reciprocally movable in the chamber along an axial direction of the chamber, and the axial directions of the first and second ports are parallel to the axial direction of the chamber.

2. The compressor of claim 1, wherein the first ports comprise at least two first inlet ports, and the second ports comprise at least two second inlet ports.

3. The compressor of claim 1, wherein each of the inlet and outlet conduits comprises a first end comprising a first flange; and a plurality of second ends each comprising a second flange, each of the second flanges of the inlet conduit for connecting the respective second end to at least one of the plurality of inlet check valves and each of the second flanges of the outlet conduit for connecting the respective second end to at least one of the first plurality of outlet check valves or at least one of the second plurality of outlet check valves; and at least one third end comprising a third flange and a removable blanking plate coupled to the third flange.

4. The compressor of claim 1, wherein each said first connection conduit and/or each said second connection conduit is partially inserted into the respective associated outlet port.

5. The compressor of claim 1, wherein the fluid is a multiphase fluid comprising a solid material.

* * * * *